US009581389B2

(12) United States Patent
Takahashi et al.

(10) Patent No.: US 9,581,389 B2
(45) Date of Patent: Feb. 28, 2017

(54) METHOD FOR HEAT TREATMENT, HEAT TREATMENT APPARATUS, AND HEAT TREATMENT SYSTEM

(71) Applicant: KANTO YAKIN KOGYO CO., LTD., Hiratsuka-shi, Kanagawa (JP)

(72) Inventors: Shinichi Takahashi, Yokohama (JP); Kiichi Kanda, Hiratsuka (JP)

(73) Assignee: KANTO YAKIN KOGYO CO., LTD., Hiratsuka-Shi, Kanagawa (JP)

( * ) Notice: Subject to any disclaimer, the term of this patent is extended or adjusted under 35 U.S.C. 154(b) by 219 days.

(21) Appl. No.: 14/388,113

(22) PCT Filed: Mar. 21, 2013

(86) PCT No.: PCT/JP2013/058038

§ 371 (c)(1),
(2) Date: Sep. 25, 2014

(87) PCT Pub. No.: WO2013/146520

PCT Pub. Date: Oct. 3, 2013

(65) Prior Publication Data

US 2015/0079527 A1 Mar. 19, 2015

(30) Foreign Application Priority Data

Mar. 27, 2012 (JP) ..... 2012-071226

(51) Int. Cl.
*F27D 19/00* (2006.01)
*C21D 1/76* (2006.01)
*C21D 11/00* (2006.01)

(52) U.S. Cl.
CPC ..... *F27D 19/00* (2013.01); *C21D 1/76* (2013.01); *C21D 11/00* (2013.01);
(Continued)

(58) Field of Classification Search
CPC ..... F27D 2019/0009; F27D 2019/012; F27D 19/00; F27D 2019/0006; F27D 2019/0018; C21D 1/76; C21D 11/00
See application file for complete search history.

(56) References Cited

U.S. PATENT DOCUMENTS 7,184,850 B1 * 2/2007 Logsdon ..... G05B 19/41865 700/100
2002/0029630 A1 * 3/2002 Blumenthal ..... F27B 5/04 73/232

(Continued)

FOREIGN PATENT DOCUMENTS

JP S60-215717 A 10/1985
JP S60-251265 A 12/1985

(Continued)

OTHER PUBLICATIONS

Cambridge, Interactive Ellingham Diagram, http://www.doitpoms.ac.uk/tlplib/ellingham_diagrams/index.php, Mar. 23, 2012, p. 1 is the interactive diagram, p. 2 is the output of the interactive diagram, pp. 3-5 are the Applications that the interactive diagram can be used for.*

(Continued)

*Primary Examiner* — Steven B McAllister
*Assistant Examiner* — Steven Anderson, II
(74) *Attorney, Agent, or Firm* — Manabu Kanesaka

(57) ABSTRACT

There are provided a method for heat treatment, a heat treatment apparatus, and a heat treatment system capable of efficiently controlling heat treatment such as a bright treatment with high precision and without causing oxidation and decarbonization. Computation of $\Delta G^0$ (standard formation Gibbs energy) is performed by referring to sensor information from respective sensors, and an Ellingham diagram, a control range, and a status of the heat treatment furnace in operation expressed with $\Delta G^0$ are displayed on a display (Continued)

device 531, while a flow rate of hydrocarbon gas is controlled by a control unit 534 so that $\Delta G^0$ is within the control range.

9 Claims, 23 Drawing Sheets

(52) U.S. Cl.
CPC ..... *F27D 2019/0006* (2013.01); *F27D 2019/0009* (2013.01); *F27D 2019/0012* (2013.01); *F27D 2019/0018* (2013.01)

(56) References Cited

U.S. PATENT DOCUMENTS

2002/0179186 A1 12/2002 Ebihara et al.
2003/0188820 A1* 10/2003 Yasuda ..... H01L 41/273 156/89.12
2004/0033455 A1* 2/2004 Tonkovich ..... B01J 19/0093 431/7
2007/0107817 A1 5/2007 Kousaka et al.
2008/0149227 A1* 6/2008 Connery ..... C23C 8/20 148/223
2008/0286708 A1* 11/2008 Ohanian ..... F27B 17/00 432/181

FOREIGN PATENT DOCUMENTS

JP H03-002317 A 1/1991
JP H05-214451 A 8/1993
JP H11-080831 A 3/1999
JP 4521257 B 8/2010
WO 2007/061012 A1 5/2007

OTHER PUBLICATIONS

PCT, "International Search Report for International Application No. PCT/JP2013/058038".

* cited by examiner

| AIR RATIO | A | B | C | D | E |
|---|---|---|---|---|---|
| | 70% | 73% | 78% | 85% | 95% |
| $CO/CO_2$ | 8.3/0.105 | 7.2/0.103 | 5.44/0.101 | 2.335/0.09 | 1.1/0.11 |
| | 79.05 | 69.90 | 53.86 | 25.94 | 10.00 |
| ΔG° | −447 | −445 | −439 | −425 | −407 |

| | A | B | C | D | E |
|---|---|---|---|---|---|
| AIR RATIO | 70% | 73% | 78% | 85% | 95% |
| $CO/CO_2$ | 8.3/0.105 | 7.2/0.103 | 5.44/0.101 | 2.335/0.09 | 1.1/0.11 |
| ⊿G° | −447 | −445 | −439 | −425 | −407 |
| COLOR | ○ | ○ | ○ | △ | × |
| TOTAL DECARBURIZED LAYER | ○ | ○ | ○ | × | × |

Fig. 22

| | | | | | | |
|---|---|---|---|---|---|---|
| Air/$CH_4$ | 2.0 | 4.1 | 6.2 | 8.2 | 10.3 | 12.4 |
| Air/$C_3H_8$ | 4.8 | 9.6 | 14.4 | 19.2 | 24.0 | 28.8 |
| Air/$C_4H_{10}$ | 6.8 | 13.7 | 20.5 | 27.3 | 34.2 | 41.1 |

METHOD FOR HEAT TREATMENT, HEAT TREATMENT APPARATUS, AND HEAT TREATMENT SYSTEM

RELATED APPLICATIONS

The present application is National Phase of International Application No. PCT/JP2013/058038 filed Mar. 21, 2013, and claims priority from Japanese Application No. 2012-071226, filed Mar. 27, 2012.

TECHNICAL FIELD

The present invention relates to a method for heat treatment, a heat treatment apparatus, and a heat treatment system, and more particularly relates to a method for heat treatment, a heat treatment apparatus, and a heat treatment system using Ellingham diagram information and having excellent mass productivity.

BACKGROUND ART

For heat treatment of metal, various heat treatments have conventionally been used depending on application purposes, the heat treatments including a standardization treatment such as annealing/normalizing, a hardening/toughening treatment, such as quenching/tempering and thermal refining, and a surface hardening treatment, such as nitriding and surface improvement. While these atmosphere heat treatments are performed in atmosphere gases, such as atmospheric air, inert gases, oxidizing gases, and reducing gases, which are supplied to a heat treatment furnace, the properties of metals that are subjected to the heat treatments are drastically changed by components of these atmosphere gases. Accordingly, it is necessary to control the components of the atmosphere gases supplied into the heat treatment furnace with sufficient precision and to visualize the status of the atmosphere in the furnace with high precision.

As a first conventional technology that performs feedback control on the flow rate of the gas supplied to a heat treatment furnace in response to a signal coming from an oxygen potentiometer placed inside the heat treatment furnace, a method of adjusting the atmosphere gas in a bright annealing furnace disclosed in Patent Literature 1 (Japanese Patent Laid-Open No. 3-2317) will be described with reference to FIG. 1. In FIG. 1, exothermic converted gas is supplied from an exothermic converted gas generator 11 to a gas mixer 13 via a dehumidifier 12, while hydrocarbon gas is supplied from a hydrocarbon gas feeder 14 to the gas mixer 13 via a flow control valve V1 so that the hydrocarbon gas is mixed with the exothermic converted gas.

The mixed gas is heated and combusted at high temperature (1100° C.) in a gas converter with heating function 15, and then the gas is quenched and dehumidified in a gas quenching/dehumidifier system 16, before being supplied to a bright annealing furnace 17. Oxygen partial pressure is measured by the oxygen potentiometer 18 provided inside the bright annealing furnace 17, and based on this measurement value, carbon potential (CP) is calculated by a carbon potential computation controller 19. Then, the calculated value is compared with a preset carbon content in an object to be treated, and the flow rate of hydrocarbon gas supplied to the gas mixer 13 is feedback-controlled via the flow control valve V1 so that the calculated value is matched with the preset carbon content. This prevents oxidation and decarbonization of the material to be treated in the bright annealing furnace 17.

Next, as a second conventional technology, a method of controlling furnace gas in bright heat treatment disclosed in Patent Literature 2 (Japanese Patent Laid-Open No. 60-215717) will be described with reference to FIG. 2.

In FIG. 2, an oxygen analyzer 22 detects the partial pressure of residual oxygen in a heat chamber 21. When the detection value is higher than a set value set in an oxygen partial pressure setting unit 24, hydrocarbon gas and reducing gas are supplied to the heat chamber 21, whereas when the detection value is lower than the set value, oxidizing gas such as air is supplied to the heat chamber 21 so as to control the amount of residual oxygen to be constant.

A carbon monoxide analyzer 23 also detects the partial pressure of residual carbon monoxide in the heat chamber 21, and when the detection value is higher than a set value set in a carbon monoxide partial pressure setting unit 25, inert gas, such as nitrogen, is discharged to the outside of the furnace while being supplied to the heat chamber 21, so that the amount of residual carbon monoxide is controlled to be constant. As a consequence, even when moisture, oxides, and oil and fat adhere to the surface of metals to be treated, the bright treatment is implemented without causing oxidation, decarbonization, carbon deposition, and carburization.

Now, as a third conventional technology, a method and an apparatus for heat treatment disclosed in Patent Literature 3 (U.S. Pat. No. 4,521,257) will be described with reference to FIG. 3.

In FIG. 3, a regulator 38 calculates CP in each of a carburization chamber 35, a diffusion chamber 36, and a soaking chamber 37 based on detection values of oxygen sensors 32, 33, and 34. The calculated values and respective CP set values are compared, and openings of respective flow rate valves are adjusted so as to control each supply flow rate of enrich gas supplied to each of the chambers.

Moreover, there is provided a sequencer 39 that controls the process in a carburizing treatment device, the sequencer 39 being configured to execute a command to cause the regulator 38 to stop and/or resume PID adjustment in accordance with the status of the carburizing device. Accordingly, during a heat treatment period including the time of opening an opening of the furnace, the CP is controlled to be constant.

Next, as a fourth conventional technology, a method and an apparatus for preventing coloration of a plate passing through reducing atmosphere furnace disclosed in Patent Literature 4 (Japanese Patent Laid-Open No. 11-80831) will be described with reference to FIG. 4.

In FIG. 4, the bright treatment is performed on a stainless steel 41 in a bright annealing furnace 42 having a color difference meter 45 provided on an outlet side. A control device 46 adjusts the circulating amount in a refining device 44 and the concentration of $H_2$ supplied from a reducing gas supply device 43, so that a difference signal between an output signal of the color difference meter 45 and a reference signal falls within a control range. This makes it possible to manufacture uniform metallic materials with a stable coloration state.

As a fifth conventional technology, a method of calculating heat treatment conditions by using an Ellingham diagram to reduce metal oxide to metal is disclosed in Patent Literature 5 (WO 2007/061012).

CITATION LIST

Patent Literature

Patent Literature 1: Japanese Patent Laid-Open No. 3-2317

Patent Literature 2: Japanese Patent Laid-Open No. 60-215717

Patent Literature 3: Japanese Patent No. 4521257

Patent Literature 4: Japanese Patent Laid-Open No. 11-80831

Patent Literature 5: WO 2007/061012

SUMMARY OF INVENTION

Technical Problem

In a first conventional technology disclosed in Patent Literature 1, in order to provide deoxidizing and decarbonizing atmosphere for heat treatment materials in the bright annealing furnace, the hydrocarbon amount is set to be within 1 to 20% of exothermic converted gas, and the amount of hydrocarbon to be mixed is corrected to an appropriate amount in proportion to a carbon content of the materials to be treated and in accordance with an oxygen partial pressure value inside the furnace measured by the oxygen potentiometer. However, no theoretical and specific description is provided regarding how to correct the appropriate amount. Moreover, it is stated that scale and decarbonization are not caused under the conditions of CO=21% vol, $CO_2$=0.5% vol, and $CO/CO_2$=42 in Table 1. However, no description is provided regarding where these conditions are positioned in a preferred range and what are prerequisites of the preferred range.

Therefore, the method of adjusting atmosphere gas in the bright annealing furnace in this gazette cannot flexibly cope with the case of the preferred conditions being changed, and the like.

In the method of controlling furnace gas in the bright heat treatment disclosed in Patent Literature 2, controlling the residual oxygen amount and the residual carbon monoxide amount to be constant are described, though no description is provided regarding how to determine a preferred condition range, i.e., the range of the bright treatment which does not cause decarbonization.

Furthermore, in the method and apparatus for heat treatment disclosed in Patent Literature 3, a description is given of calculating carbon potential based on the oxygen concentration output from an oxygen sensor and performing feedback control on the flow rate of enrich gas so that the carbon potential converges to a set value in a carburization heat treatment. However, the feedback control is only performed so that the carbon potential converges to the preset value, and it is impossible to identify where, in the preferred condition range and in the condition range out of the preferred conditions, the furnace is currently operated. Moreover, when the preferred conditions are changed or the like, it is impossible to dynamically cope with the change. Furthermore, it is not at all discussed that when defective articles are generated in mass production, operation conditions of the furnace are analyzed based on preset optimum conditions and signals from sensors from an operation history, and failure analysis of a lot that includes the defective articles is performed.

The method and apparatus for preventing coloration of a plate passing through reducing atmosphere furnace disclosed in Patent Literature 4 have the same problem as the conventional technology disclosed in Patent Literature 3.

In the heat treatment methods disclosed in Patent Literatures 1 to 4, there is no description or suggestion about displaying the status of the heat treatment furnace in operation on a display device in the form of a point on an Ellingham diagram in real time.

As for a metal manufacturing method disclosed in Patent Literature 5, calculation of $\Delta G^0$ is disclosed in paragraph [0011] in this gazette. However, using this $\Delta G^0$ as means for displaying the status of the heat treatment furnace in operation, and how to control the status of the heat treatment furnace expressed by $\Delta G^0$ are not disclosed.

In all the documents stated above, no disclosure is made about visualizing the current status of atmosphere in the furnace with high precision and controlling the status of the furnace by using the visualized information.

Solution to Problem

The present invention provides a method for heat treatment, a heat treatment apparatus, and a heat treatment system which suitably solved the aforementioned problems.

The heat treatment apparatus of the present invention includes: a heat treatment furnace that heat-treats materials to be treated; a gas supply device that supplies atmosphere gas to the heat treatment furnace; a control system that controls the gas supply device by referring to sensor information from a sensor; a standard formation Gibbs energy computation unit that calculates a standard formation Gibbs energy of the atmosphere gas in the heat treatment furnace by referring to the information from the sensor; and a display data generation unit that generates an Ellingham diagram of the heat treatment furnace and the standard formation Gibbs energy as display data to be displayed on the Ellingham diagram corresponding to temperature of the heat treatment furnace.

The display data generation unit generates the display data including a control range of the heat treatment furnace in the Ellingham diagram.

Moreover, the control range includes: a first control range indicative of a normal operation range of the heat treatment furnace; a second control range outside the first control range, wherein when a status on the Ellingham diagram is out of the first control range and goes into the second control range, an alarm is output but operation is continued; and a third control range outside the second control range, wherein when the status goes into the third control range, operation of the heat treatment apparatus is stopped.

The standard formation Gibbs energy computation unit may perform computation by using any information or a plurality of information pieces from oxygen partial pressure, carbon monoxide partial pressure and carbon dioxide partial pressure, and hydrogen partial pressure and dew point information to calculate the standard formation Gibbs energy.

Further, the standard formation Gibbs energy computation unit may compute the standard formation Gibbs energy by using any one of the following methods including: a method for computation with use of a carbon monoxide sensor and a carbon dioxide sensor or a method for computation with use of only the carbon dioxide sensor if the partial pressure of carbon monoxide is obtained in advance; a method for computation with use of a hydrogen sensor and a dew-point sensor or a method for computation with use of only the dew-point sensor if the partial pressure of hydrogen is obtained in advance; a method for computation with use of an oxygen sensor; and a method for computation with use of a combination of the above-described methods.

The heat treatment apparatus may include a status monitoring & abnormality processing unit that directly monitors a status on the Ellingham diagram, outputs an alarm when the status deviates from the first control range, and outputs control information so as to stop the operation of the heat treatment apparatus when the status shifts to the third control range.

The heat treatment apparatus may include a heat treatment database that stores at least one of process information on the materials to be treated, log information about operation of the heat treatment apparatus, and accident information.

Moreover, a plurality of process conditions for evaluation are set for the materials to be treated, the materials to be treated that are heat-treated in each of these conditions are evaluated, and the control range is defined based on the evaluation results.

When a lot number of the materials to be treated is specified in case where the status of the materials to be treated shifts in sequence, the Ellingham diagram of the materials to be treated may sequentially be displayed on an identical screen or a plurality of screens.

The heat treatment database may include: a file of materials to be treated that stores a list or a library of the materials to be treated including at least one of carbon steel and steel containing an alloy element; and a process control file that stores a list or a library of the heat treatment including at least one of a bright treatment, a refining treatment, and a hardening/tempering treatment.

Further, the heat treatment apparatus may include a display device that simultaneously or switchingly displays at least two or more out of the Ellingham diagram, a chart indicative of time transition in control parameter of the heat treatment apparatus, and the information from the sensor.

The sensor and the control system may be connected via a communication line, so that the control system may monitor in real time whether the sensor and the communication line normally operate, while performing offset correction and noise correction of a signal from the sensor.

A heat treatment system of the present invention is a heat treatment apparatus including: a heat treatment furnace that heat-treats materials to be treated; a gas supply device that supplies reducing gas to the heat treatment furnace; a control system that controls the gas supply device by referring to sensor information from a sensor; a standard formation Gibbs energy computation unit that calculates standard formation Gibbs energy of the atmosphere gas in the heat treatment furnace by referring to the information from the sensor; a display data generation unit that generates an Ellingham diagram of the heat treatment furnace and the standard formation Gibbs energy as display data to be displayed on the Ellingham diagram corresponding to temperature of the heat treatment furnace; and a terminal device that displays the display data via a communication line, while transmitting the control information for controlling the control system.

A method for heat treatment of the present invention is a method for heat treatment that heat-treats materials to be treated in atmosphere gas supplied to a heat treatment furnace, the method including: calculating standard formation Gibbs energy of the atmosphere gas in the heat treatment furnace by referring to information from respective sensors that detect a status during heat treatment; and generating an Ellingham diagram of the heat treatment furnace and the standard formation Gibbs energy as display data to be displayed on the Ellingham diagram corresponding to temperature of the heat treatment furnace.

Advantageous Effects of Invention

The method for heat treatment, the heat treatment apparatus, and the heat treatment system according to the present invention can display an Ellingham diagram, a control range, and an operational status of the heat treatment furnace on a display device, so that the operational status of the heat treatment furnace can be monitored in real time from a perspective of the Ellingham diagram.

The method for heat treatment, the heat treatment apparatus, and the heat treatment system according to the present invention can grasp whether or not the status of the heat treatment furnace is within the control range set on the Ellingham diagram and two-dimensionally grasp a margin to a boundary of the control range when the status is in the control range. Furthermore, the control range is divided into a normal operation range, an alarm output/continuous operation range set outside the normal operation range, and an operation stop range set further outside the alarm output/continuous operation range to normalize a control method in each range, so as to achieve decrease in occurrence rate of a defective lot and reduction in operation stop period. As a consequence, the heat treatment apparatus excellent in mass productivity can be provided.

Further in the method for heat treatment, the heat treatment apparatus, and the heat treatment system according to the present invention, sensor signals regarding the operational status, shift in system status on the Ellingham diagram and the like are stored as log data, which makes it easy to perform failure analysis and the like. Moreover, alarm information can be sent to persons concerned before fatal shutdown occurs, and quick recovery to the normal operation condition can be implemented.

Further in the method for heat treatment, the heat treatment apparatus, and the heat treatment system according to the present invention, data about materials to be treated and treatment processes is stored in a database as libraries. When the materials to be treated and the treatment processes are changed, it becomes possible to swiftly switch the operation of the heat treatment furnace by selecting these libraries. Therefore, the present invention is also applicable to limited manufacture with a wide variety.

Furthermore, when the method for heat treatment, the heat treatment apparatus, and the heat treatment system according to the present invention are applied to the bright annealing heat treatment, it becomes unnecessary to execute after-treatments, such as acid pickling performed after the heat treatment since the product surface is bright-finished, or it becomes possible to omit a process (such as cutting, etching and polishing) for removing a decarburized layer after the heat treatment since decarbonization does not occur on the surface in the process of the heat treatment.

BRIEF DESCRIPTION OF DRAWINGS

FIG. 22 is an explanatory view of the details of the heat treatment conditions of FIG. 21 and evaluation results.

DESCRIPTION OF EMBODIMENTS

Hereinafter, the embodiments of a method for heat treatment, a heat treatment apparatus, and a heat treatment system of the present invention will be described with reference to the drawings.

Figure 1:
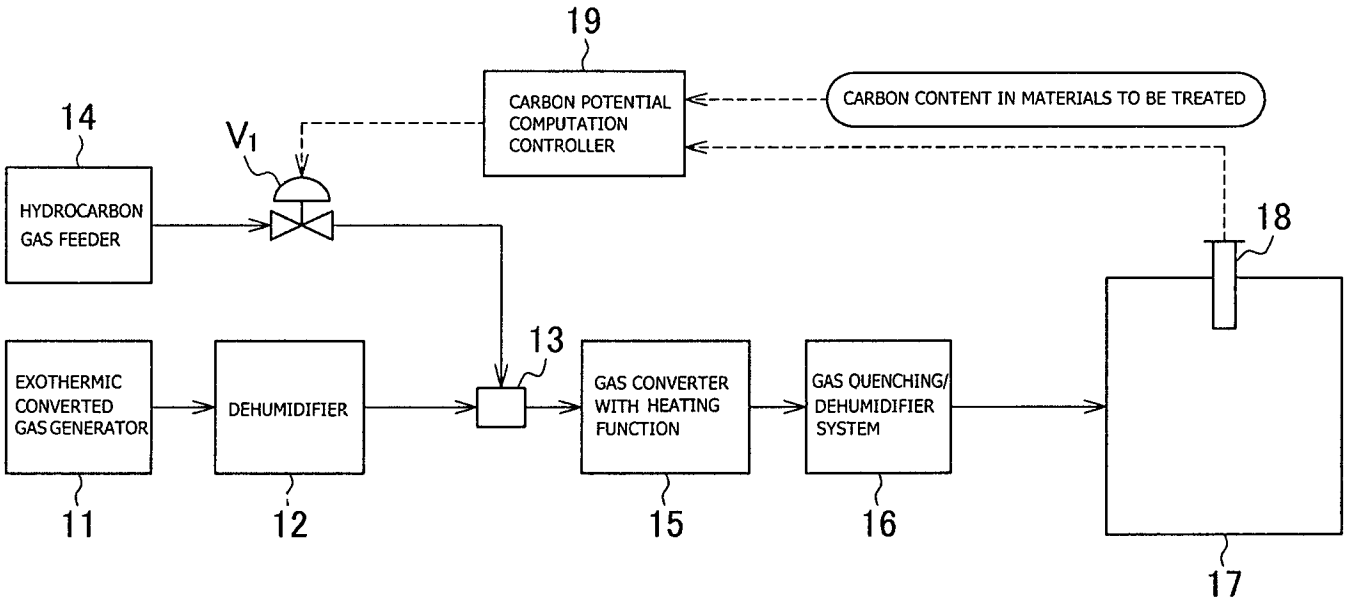
Fig. 1 Prior Art
FIG. 1 is a block diagram representing a bright annealing furnace in a first conventional technology.
Figure 2:
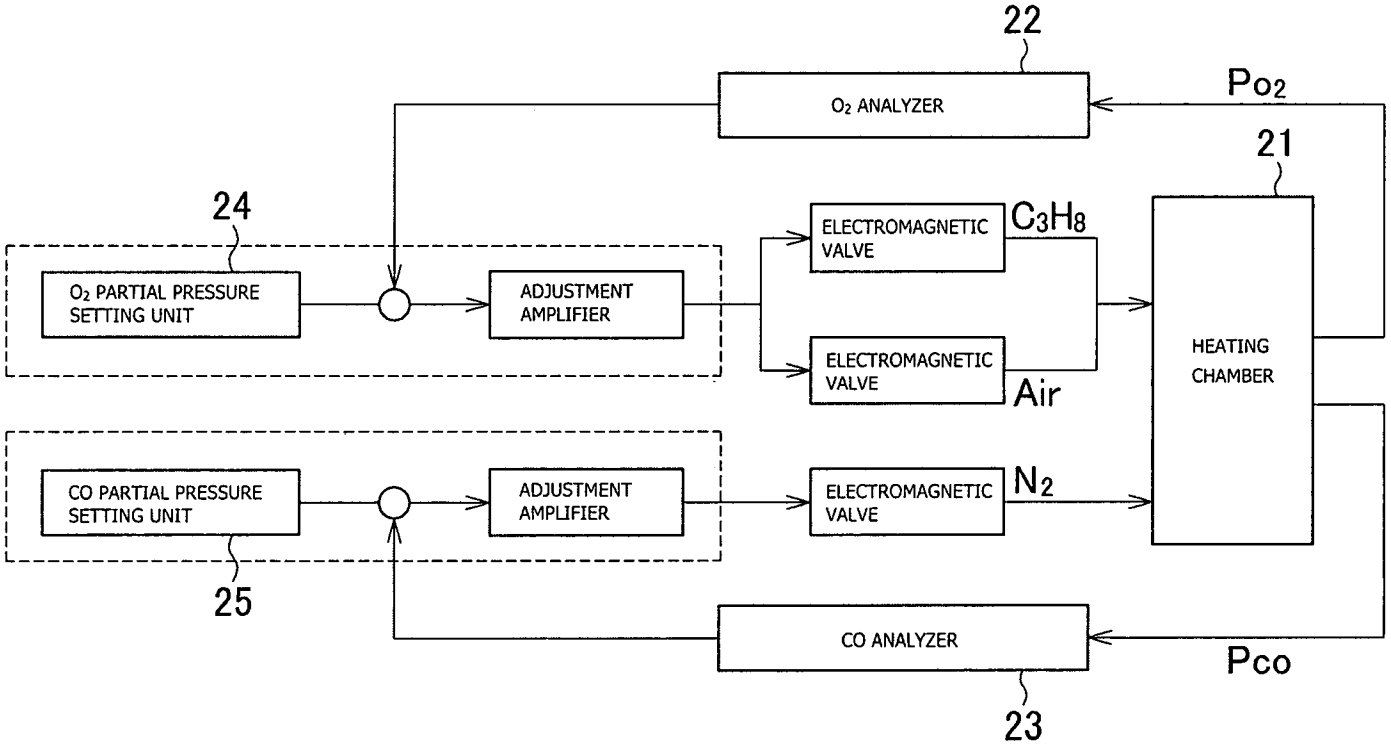
Fig. 2 Prior Art
FIG. 2 is a block diagram illustrating an automatic controller of a bright heat treatment furnace in a second conventional technology.
Figure 3:
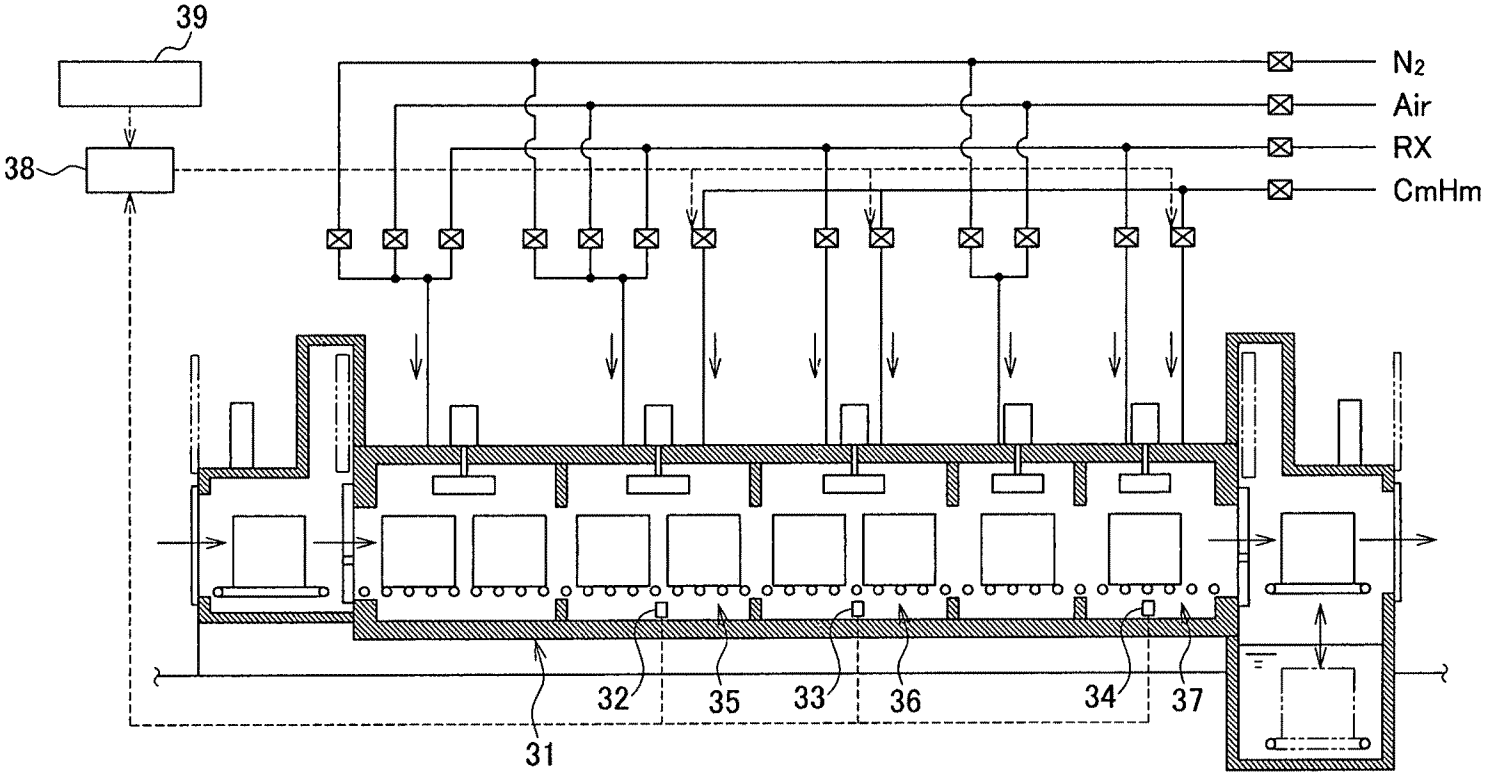
Fig. 3 Prior Art
FIG. 3 is a schematic cross sectional view of a carburizing device in a third conventional technology.
Figure 4:
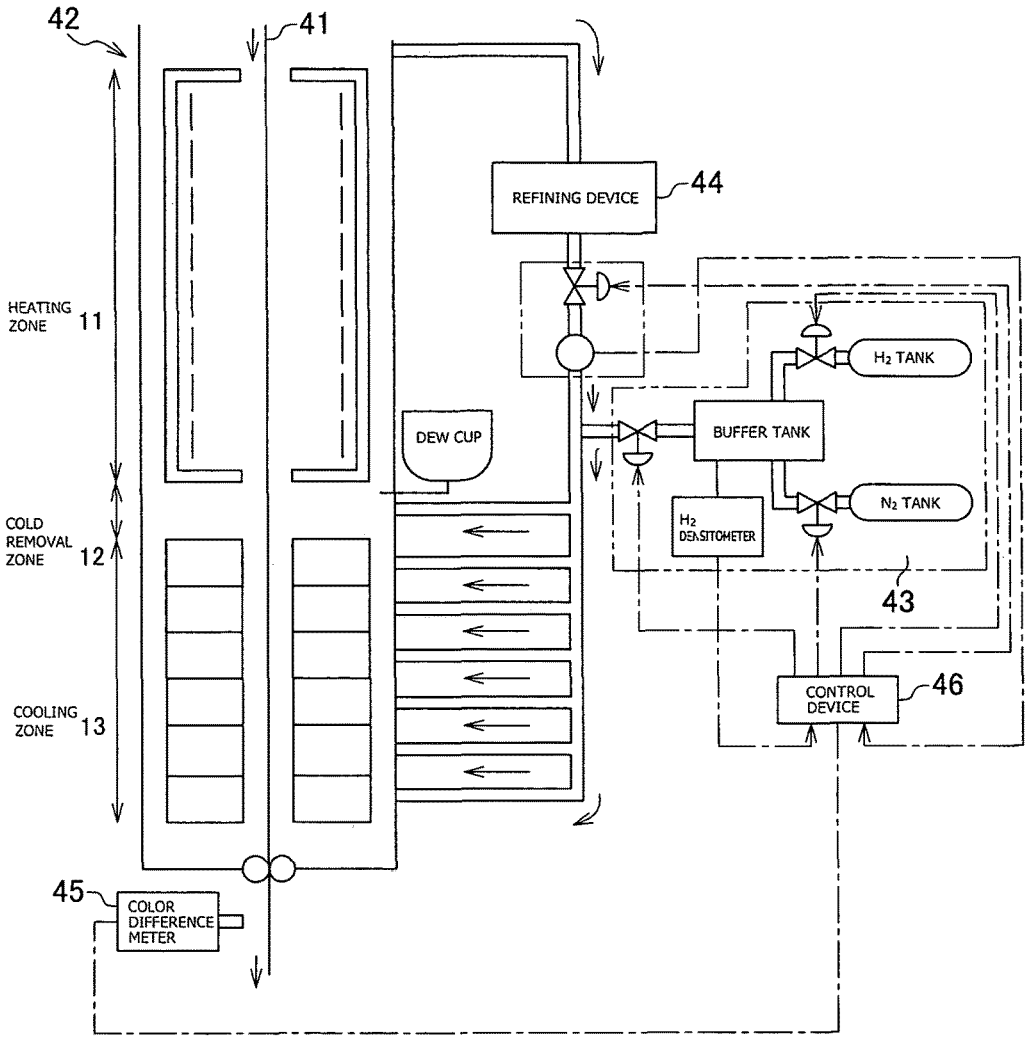
Fig. 4 Prior Art
FIG. 4 is a block diagram illustrating the schematic configuration of an apparatus for preventing coloration of a plate passing through reducing atmosphere furnace in a fourth conventional technology.
Figure 5:
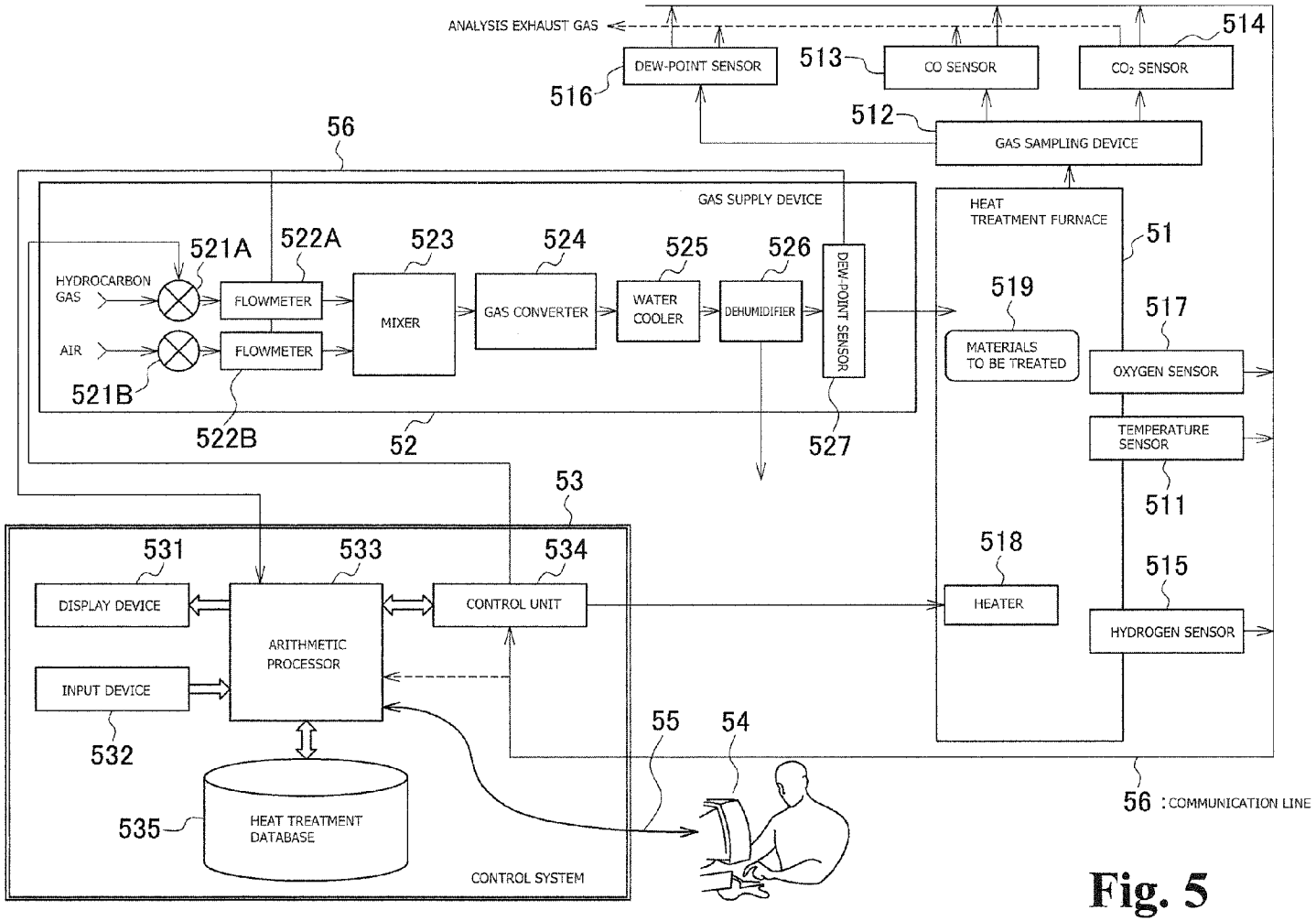
FIG. 5 is a block diagram illustrating the schematic configuration of a heat treatment apparatus and a heat treatment system according to an embodiment of the present invention, and a first embodiment of the heat treatment apparatus of the present invention.

FIG. 5 is a block diagram illustrating the schematic configuration of the heat treatment apparatus and the heat treatment system of the present invention. Materials to be treated 519 brought into the heat treatment furnace 51 are subjected to heat treatment such as a bright treatment, a refining treatment, and a hardening/tempering treatment, in reducing atmosphere gas at a specified high temperature set by a heater 518.

Moreover, there are provided a gas supply device 52 that generates the atmosphere gas that is supplied to the heat treatment furnace 51, a control system 53 that controls temperature of the heat treatment furnace 51 and controls the gas supply device 52 and the like in response to signals from various sensors, and a terminal device 54 that reciprocally outputs and inputs information via the control system 53 and a communication line 55.

The heat treatment furnace 51 includes various sensors, and more specifically includes a temperature sensor 511 that measures temperature, an oxygen sensor 517 that measures residual oxygen ($O_2$) partial pressure, a hydrogen sensor 515 that measures hydrogen ($H_2$) partial pressure, and a dew-point sensor 516 that measures a dew point inside the heat treatment furnace 51.

There are also provided a gas sampling device 512 that samples a part of the atmosphere gas in the heat treatment furnace 51, and a CO sensor 513 and a $CO_2$ sensor 514 that respectively measure carbon monoxide (CO) partial pressure and carbon dioxide ($CO_2$) partial pressure of the sampled atmosphere gas by using infrared ray spectroscopy. The atmosphere gas analyzed with the CO sensor 513, the $CO_2$ sensor 514, and the dew-point sensor 516 is discharged as analysis exhaust gas.

Although the temperature sensor is an indispensable sensor, it is not necessary to provide all the other sensors. More specifically, there are following methods of measuring standard formation Gibbs energy $\Delta G^0$ of the heat treatment furnace 51: (1) a method of using the CO sensor 513 and the $CO_2$ sensor 514 or a method of using only the $CO_2$ sensor 514 when the partial pressure of carbon monoxide is provided in advance; (2) a method of using the hydrogen sensor 515 and the dew-point sensor 516 or a method of using only the dew-point sensor 516 when the partial pressure of hydrogen is provided in advance; (3) a method of using the oxygen sensor 517; and (4) a method of using a combination of the methods (1) to (3). In accordance with these methods (1) to (4), necessary sensors may be provided.

The gas supply device 52 includes: a flow control valve 521A that controls a flow rate of hydrocarbon gas such as town gas, methane ($CH_4$), propane ($C_3H_8$), and butane ($C_4H_{10}$); a flow control valve 521B that controls an air flow rate; a flowmeter 522A and a flowmeter 522B that respectively measure flow rates of flow rate-controlled hydrocarbon gas and air; and a mixer 523 that mixes the flow rate-controlled hydrocarbon gas and air, in response to control signals of a control unit 534.

The mixed gas mixed in the mixer 523 produces an exothermic chemical reaction and combusts in the gas converter 524, and the further-combusted high-temperature converted gas is water-cooled to about 40° C. with a water cooler 525. The water-cooled gas is dehumidified in a dehumidifier 526 and is supplied as DX gas to the dew-point sensor 527 and to a drain hole. More specifically, when the conditions such as the temperature of the heat treatment furnace 51 do not satisfy specific heat treatment conditions, the gas is discharged to the drain hole from the dehumidifier 526 without being supplied to the heat treatment furnace 51.

Although the dew-point sensor 527 is provided in order to detect deviation of the dew point from a normal standard range due to occurrence of abnormalities in the gas supply device 52 and the like, the precision of the dew-point sensors which are currently available on the market leaves much to be desired. Accordingly, any one of the following methods may be used or a plurality thereof may be used in union: (1) a method of detecting whether or not a dew point is normal by using dew point information from the dew-point sensor and information from an unillustrated hydrogen sensor provided on an output portion of the gas supply device 52; (2) a method of detecting whether or not the dew point is normal by using information from an unillustrated oxygen sensor provided on the output portion of the gas supply device 52;

(3) a method of detecting whether or not the dew point is normal by using information from an unillustrated carbon dioxide sensor provided on the output portion of the gas supply device 52; and (4) a method of detecting whether or not the dew point is normal by using information from unillustrated carbon monoxide sensor and carbon dioxide sensor provided on the output portion of the gas supply device 52. This method also applies to the following embodiments.

Meanwhile, when the heat treatment furnace 51 meets given heat treatment conditions, gas is started to be supplied from the dehumidifier 526 to the heat treatment furnace 51. This prevents the atmosphere gas from being supplied to the heat treatment furnace 51 when the heat treatment conditions of the heat treatment furnace 51 are not yet satisfied.

After steam ($H_2O$) partial pressure is finally measured with the dew-point sensor 527, the gas from the dehumidifier 526 is supplied to the heat treatment furnace 51 as atmosphere gas. The dew-point sensor 527 may be configured integrally with the dehumidifier 526.

The control system 53 has a display device 531 that displays an operational status of the heat treatment furnace, more specifically, a point that represents the status on an Ellingham diagram, and information such as a control range set on the Ellingham diagram. The control system 53 also has an input device 532 that outputs input information to an arithmetic processor 533. Further, there is provided an arithmetic processor 533 that uses signals from various sensors placed inside the heat treatment furnace 51 and from the CO sensor 513, the $CO_2$ sensor 514, and the dew-point sensor 527 provided outside the heat treatment furnace 51 and uses the information stored in a heat treatment database 535 to perform arithmetic processing. The arithmetic processor 533 also outputs control signals for controlling the flow control valves 521A, 521B and the like to the control unit 534. There are also provided the control unit 534 that controls the heater 518, the flow control valve 521A and the like in response to the control signals from the arithmetic processor 533, and the heat treatment database 535 that stores and manages material information on the materials to be treated 519, process information about the heat treatment, information about the control range, log information about operation of the heat treatment apparatus, accident data, and the like.

Moreover, the various sensors, such as the temperature sensor 511, the oxygen sensor 517, the CO sensor 513, and the $CO_2$ sensor 514, are connected to the control unit 534 or the arithmetic processor 533 via the communication line 56, such as a dedicated sensor bus, a general-purpose bus, or a wireless LAN. The control unit 534 or the arithmetic processor 533 monitors in real time whether or not the various sensors and the communication line 56 normally operate, while performing processing such as detection of signals from various sensors, sampling, A/D conversion, waveform equivalence, offset correction, and noise correction.

Next, the configuration and operation of the arithmetic processor 533 will be described with reference to FIGS. 5 and 6.

The arithmetic processor 533 includes: a sensor I/F 67 that receives signals from various sensors; an oxygen partial pressure computation unit 61 that calculates the oxygen partial pressure in the heat treatment furnace 51 with reference to the signals from the oxygen sensor 517 input via the sensor I/F 67; a $CO/CO_2$ partial pressure ratio computation unit 62 that calculates a $CO/CO_2$ partial pressure ratio with reference to signals input from the CO sensor 513 and the $CO_2$ sensor 514; and an $H_2/H_2O$ partial pressure ratio computation unit 63 that calculates $H_2$ partial pressure with reference to a signal from the hydrogen sensor 515 while calculating an $H_2/H_2O$ partial pressure ratio with reference to a signal from the dew-point sensor 516.

A $\Delta G^0$ (standard formation Gibbs energy) computation unit 64 refers to the calculation results calculated respectively in the oxygen partial pressure computation unit 61, the $CO/CO_2$ partial pressure ratio computation unit 62, and the $H_2/H_2O$ partial pressure ratio computation unit 63 to calculate $\Delta G^0$ (standard formation Gibbs energy) of the heat treatment furnace 51 in operation, and outputs the calculation result to a display data generation unit 65, the control unit 534, and a status monitoring & abnormality processing unit 66.

There are several methods of calculating $\Delta G^0$, and some typical calculation methods will be described below.

$$\Delta G^0 = RT.\ln P(O_2) \quad (1)$$

[Reaction among $CO—CO_2—O_2$]

$$2CO + O_2 = CO_2 \quad (2)$$

$$\Delta G^0(2) = -564980 + 173.3T \ (J\text{-}.mol^{-1}) \quad (3)$$

$$RT\ln P(O_2) = \Delta G^0(2) - 2RT\ln(P(CO)/P(CO_2)) \quad (4)$$

[Reaction among $H_2—H_2O—O_2$]

$$2H_2 + O_2 = 2H_2O \quad (5)$$

$$\Delta G^0(5) = -496070 + 111.5T \ (J.mol^{-1}) \quad (6)$$

$$RT.\ln P(O_2) = \Delta G^0(5) - 2RT\ln(P(H_2)/P(H_2O)) \quad (7)$$

Here, R represents a gas constant, T represents absolute temperature, $P(O_2)$ represents oxygen partial pressure ($O_2$ partial pressure), P(CO) represents carbon monoxide partial pressure (CO partial pressure), $P(CO_2)$ represents carbon dioxide partial pressure ($CO_2$ partial pressure), $P(H_2)$ represents hydrogen partial pressure ($H_2$ partial pressure), and $P(H_2O)$ represents partial pressure of water (steam) ($H_2O$ partial pressure).

In the above-stated formulas, $\Delta G^0$ can be calculated from the oxygen partial pressure $P(O_2)$ by using the formula (1). The formula (2) represents a reaction among carbon monoxide (CO), oxygen ($O_2$) and carbon dioxide ($CO_2$), while the formula (3) indicates that $\Delta G^0$ (standard formation Gibbs energy) in this system of reaction is calculated with a linear function of absolute temperature (T).

Based on the formula (4), $RT\ln P(O_2)$ can be calculated by using a partial pressure ratio between carbon monoxide (CO) partial pressure and carbon dioxide ($CO_2$) partial pressure, by which $\Delta G^0$ can be obtained.

The formula (5) represents a reaction among hydrogen ($H_2$), oxygen ($O_2$) and a steam ($H_2O$), while the formula (6) indicates that $\Delta G^0$ (standard formation Gibbs energy) in this system of reaction is calculated with a linear function of absolute temperature (T).

Based on the formula (7), $RT\ln P(O_2)$ can be calculated by using a partial pressure ratio between hydrogen ($H_2$) partial pressure and steam ($H_2O$) partial pressure, by which $\Delta G^0$ can be obtained.

Next, the sensors necessary for calculation of $\Delta G^0$ will be described.

When attention is focused on the formula (1), $\Delta G^0$ can be calculated when the absolute temperature T and the oxygen partial pressure $P(O_2)$ are detected. Therefore, the temperature sensor 511 and the oxygen sensor 517 may be provided.

When attention is focused on the reaction among $CO—CO_2—O_2$ to calculate $\Delta G^0$ (standard formation Gibbs energy) by using the formula (4), the CO partial pressure and the $CO_2$ partial pressure need to be detected. Accordingly, the sensors to be provided may be the CO sensor 513 and the $CO_2$ sensor 514. When the CO partial pressure is obtained in advance, only the $CO_2$ sensor 514 may be provided.

When attention is focused on the reaction among $H_2$—$H_2O$—$O_2$ to calculate $\Delta G^0$ (standard formation Gibbs energy) by using the formula (7), the $H_2$ partial pressure and the $H_2O$ partial pressure need to be detected. Accordingly, the sensors to be provided may be the hydrogen sensor 515 and the dew-point sensor 516. When $H_2$ partial pressure is obtained in advance, only the dew-point sensor 516 may be provided.

Moreover, precision may be enhanced by such a method of calculating $\Delta G^0=RT\ln P(O_2)$ according to the formula (1), $\Delta G^0=RT\ln P(O_2)=\Delta G^0$ (2)$-2RT\ln(P(CO)/P(CO_2))$ according to the formula (4), and $\Delta G^0=\Delta G^0$ (5)$-2RT\ln(P(H_2)/P(H_2O))$ according to the formula (7) and selecting a method estimated to have the highest precision, or averaging, weighted-averaging or statistically processing respective calculation results.

Figure 6:
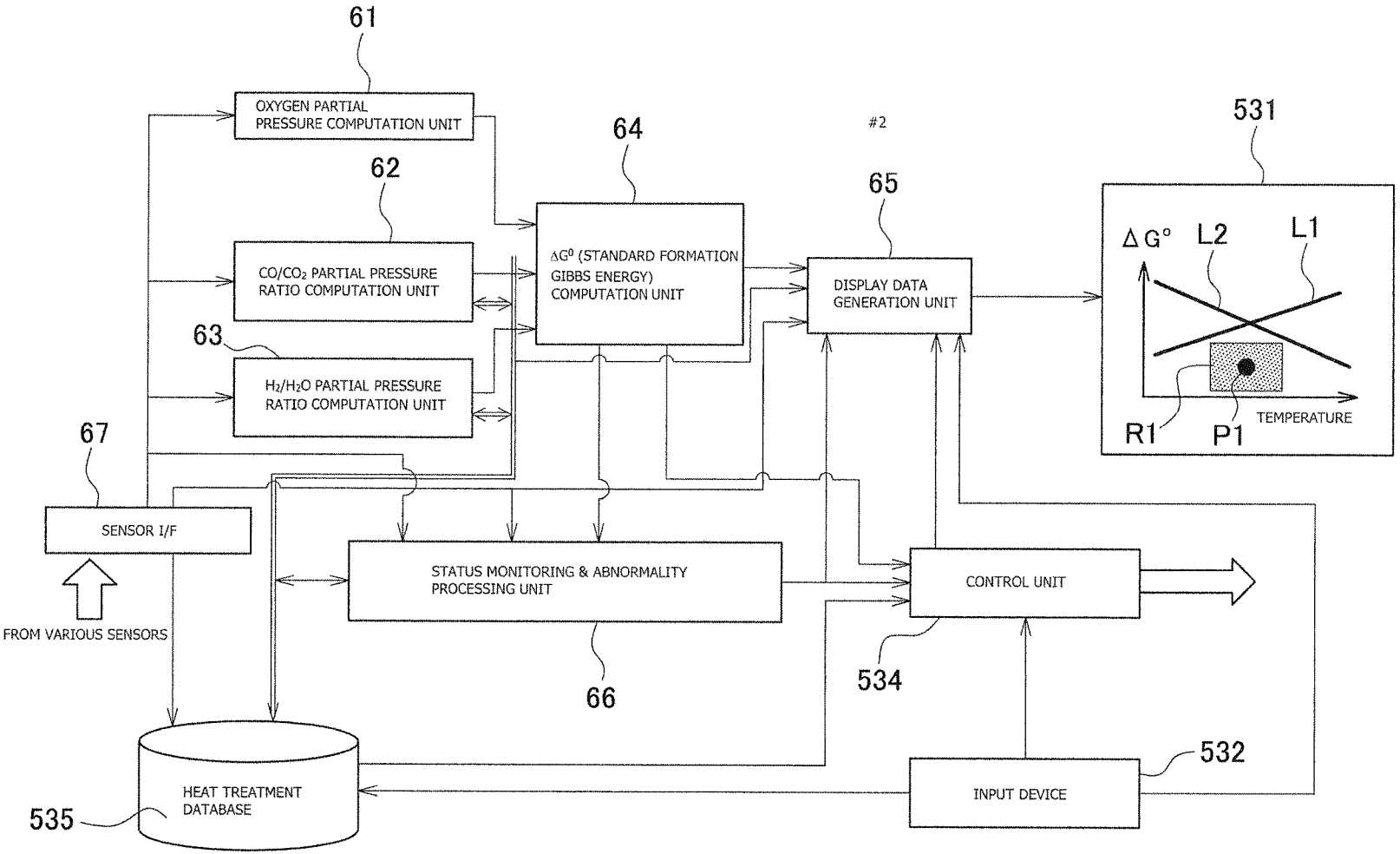
FIG. 6 is a detailed block diagram of a control system illustrated in FIG. 5.

Returning to the description with reference to FIG. 6, the display data generation unit 65 uses $\Delta G^0$ (standard formation Gibbs energy) output from the $\Delta G^0$ computation unit 64, the temperature information input from the temperature sensor 511 via the sensor I/F 67, the Ellingham diagram corresponding to the material to be treated 519 specified by the input device 532, the information on the control range on the Ellingham diagram corresponding to the materials to be treated 519, and the like, to generate display data to be displayed on the display device 531. A plurality of Ellingham diagrams corresponding to various materials to be treated 519, such as carbon steel and steel containing an alloy element, and the information on the control ranges corresponding to these Ellingham diagrams are accumulated in the heat treatment database 535. Information on new materials to be treated and control ranges is updated periodically or un-periodically.

The display device 531 displays the display data output from the display data generation unit 65 with temperature as an abscissa and $\Delta G^0$ as an ordinate, in which standard formation Gibbs energy of the materials to be treated 519 at respective temperatures is displayed as an approximate straight line L1 while standard formation Gibbs energy in the reaction of $2C+O_2=2CO$ is displayed as an approximate straight line L2. A control range R1 and a status P1 of the heat treatment furnace 51 calculated by the $\Delta G^0$ (standard formation Gibbs energy) computation unit 64 are simultaneously displayed on an Ellingham diagram. The status P1 is updated at every sampling time by various sensors, e.g., at every second on a display screen. While the control range R1 and the status P1 are essential as the information displayed on the display device 531, the approximate straight line L1 and the approximate straight line L2 are not necessarily essential in mass-production heat treatment apparatuses. Moreover, the update period may arbitrarily be set.

With reference to the Ellingham diagram displayed on the display device 531, an operator of the heat treatment apparatus illustrated in FIG. 5 can two-dimensionally understand the status of the heat treatment furnace 51 currently in operation. More specifically, when the status P1 is within the control range R1, the operator determines that the heat treatment such as the bright treatment, the refining treatment, and the hardening/tempering treatment are normally processed, and continues operation. Contrary to this, when the status P1 is out of the control range R1, it is possible to recognize in real time that a certain abnormality occurs in the heat treatment furnace 51, and in the worst case scenario, the operation of the heat treatment apparatus is stopped, so that mass production of defective articles can be prevented.

The status monitoring & abnormality processing unit 66 monitors in real time the parameters including temperature, $O_2$ partial pressure, CO partial pressure, $CO_2$ partial pressure, $H_2$ partial pressure, $H_2O$ partial pressure in the heat treatment furnace 51, a $CO/CO_2$ partial pressure ratio, an $H_2/H_2O$ partial pressure ratio, and $\Delta G^0$, while reading the control range R1 corresponding to the materials to be treated 519 and the like from the heat treatment database 535 and outputting an abnormal signal to the control unit 534 when the above-described parameters deviate from the specified control range.

Figure 7:
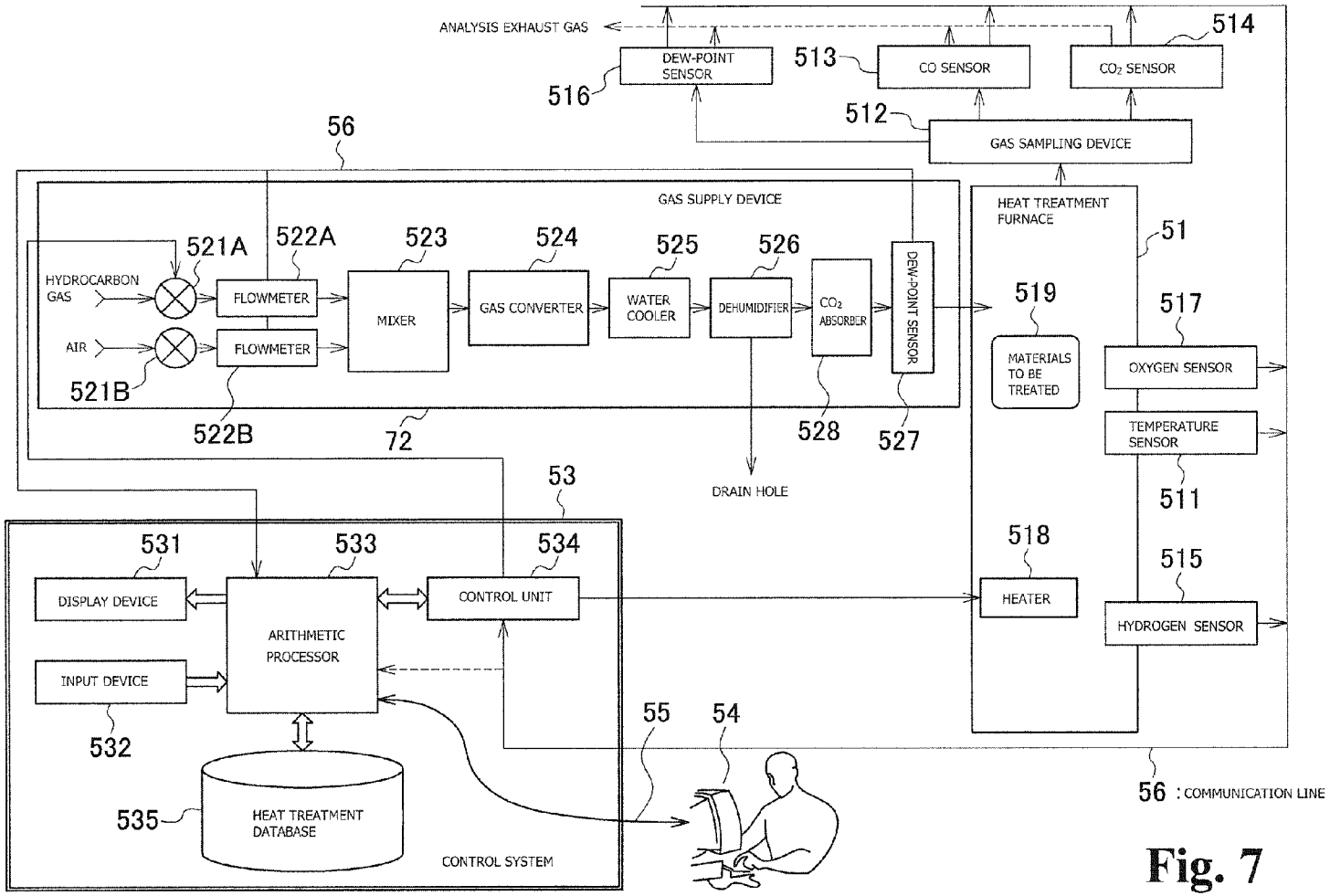
FIG. 7 is a block diagram illustrating the schematic configuration of a second embodiment of the heat treatment apparatus of the present invention.

A description is now given of a second embodiment of the heat treatment apparatus of the present invention with reference to FIG. 7.

The heat treatment apparatus described in FIG. 7 has a gas supply device 72 which is different in configuration from the gas supply device 52 illustrated in FIG. 5. The configuration of the heat treatment furnace 51 and the control system 53 is basically similar to that in FIG. 5. The gas supply device 72 in the second embodiment has a $CO_2$ absorber 528 on an output side of the dehumidifier 526 in the gas supply device 52 of the first embodiment, so that the $CO_2$ absorber 528 removes $CO_2$ in the converted gas generated in the gas converter 524, and supplies NX gas to the heat treatment furnace 51 as atmosphere gas. In this case, since residual $CO_2$ partial pressure is about 0.1%, it can sufficiently be detected by the $CO_2$ sensor 514. Since the surface of the material to be treated 519 is heat-treated by NX gas, the heat treatment of the present embodiment is performed in the atmosphere whose partial water vapor pressure and carbon dioxide partial pressure are lower than those in the first embodiment, so that decarbonization can be prevented and the bright treatment can efficiently be performed. The configuration of the arithmetic processor 533 and the calculating method of $\Delta G^0$ in the present embodiment are basically similar to those in the first embodiment.

Figure 8:
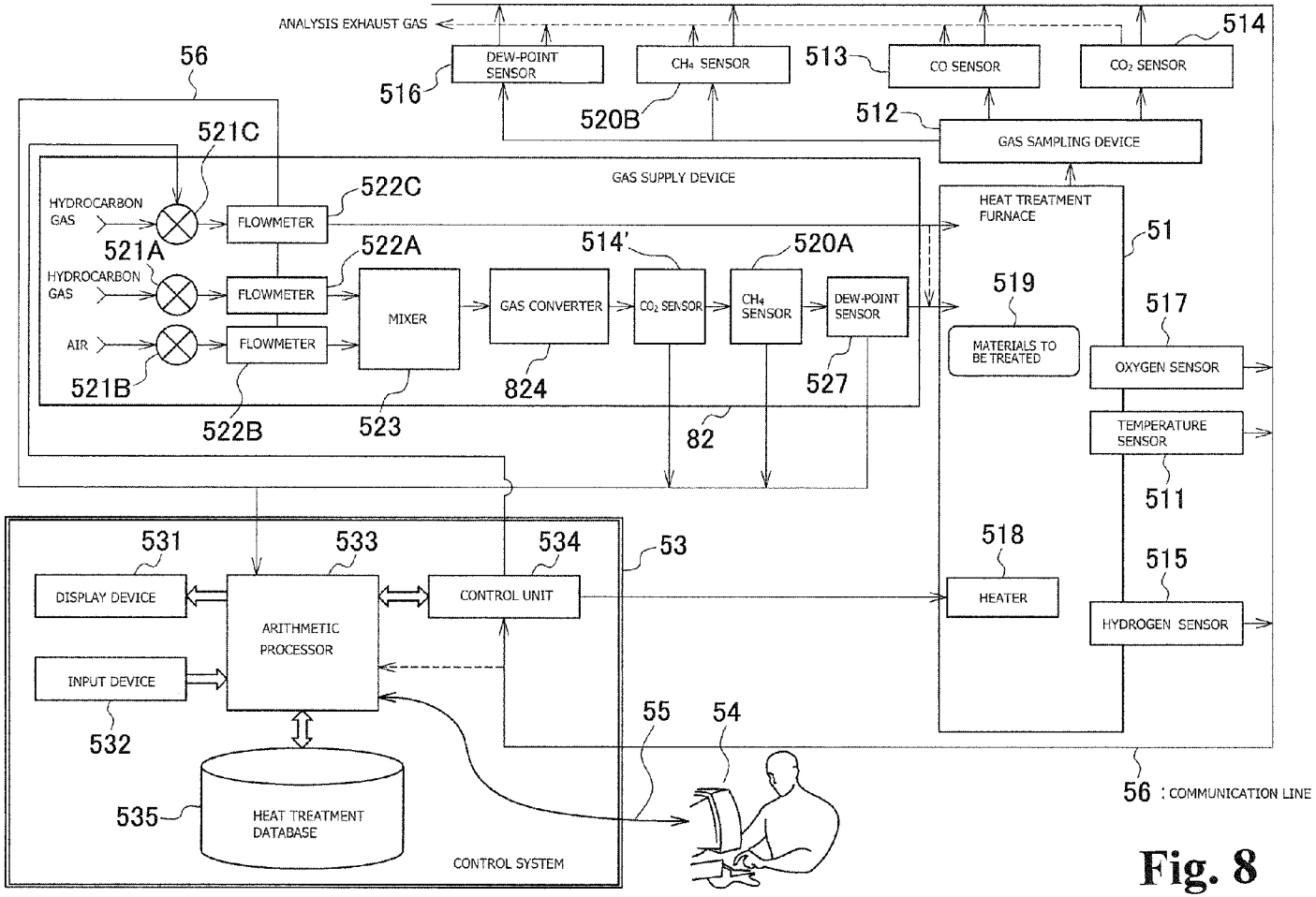
FIG. 8 is a block diagram illustrating the schematic configuration of a third embodiment of the heat treatment apparatus of the present invention.

A description is now given of a third embodiment of the heat treatment apparatus of the present invention with reference to FIG. 8.

A gas supply device 82 illustrated in FIG. 8 includes: a mixer 523 that mixes hydrocarbon gas supplied via a flow control valve 521A and a flowmeter 522A and air supplied via a flow control valve 521B and a flowmeter 522B; a gas converter 824 that combusts the mixed gas from the mixer 523; a $CO_2$ sensor 514' that measures $CO_2$ partial pressure of the converted gas generated in the gas converter 824; a $CH_4$ sensor 520A that measures partial pressure of methane ($CH_4$) in the converted gas; and a dew-point sensor 527 that measures a dew point of the converted gas and supplies the gas to the heat treatment furnace 51 as RX gas. The gas supply device 82 also supplies hydrocarbon gas as enrich gas to the heat treatment furnace 51 via a flow control valve 521C and a flowmeter 522C. Although the configuration of measuring $CO_2$ partial pressure of the converted gas first and then measuring $CH_4$ partial pressure is illustrated in FIG. 8, the configuration of measuring $CH_4$ partial pressure of converted gas first and then measuring $CO_2$ partial pressure may be employed. Moreover, although the $CH_4$ sensor 520A is an essential sensor in the above-described configuration, the $CO_2$ sensor 514' and the dew-point sensor 527 are not necessarily essential and may be omitted.

In the heat treatment apparatus of the present embodiment, the chemical reaction in the gas converter 824 causes the flow rate of air to be lowered, so that it is defined as an endothermic reaction. Although use of a catalyst is devised to cause a stable chemical reaction, reaction temperature inside the gas converter 824 may sometimes varies and CO partial pressure and $CO_2$ partial pressure may become different from their set values. Moreover, in order to generate RX gas from the gas converter 824, the flow control valve 521B is tightened to lower the air flow rate. However, if the air flow rate is excessively lowered, soot is generated, which drastically change CO partial pressure and $CO_2$ partial pressure from their set values. Accordingly, an appropriate air flow rate is maintained, and hydrocarbon gas (raw gas) such as propane and butane is supplied as it is, or the hydrocarbon gas is mixed with RX gas generated in the gas converter 824 and is supplied to the heat treatment furnace 51 together with the RX gas, so that CO partial pressure and $CO_2$ partial pressure inside the heat treatment furnace 51 can be kept stable.

In the heat treatment apparatus in the third embodiment, which is unlike the heat treatment apparatus in the second embodiment, the heat treatment furnace 51 has atmosphere gas with a high CO partial pressure and a low $CO_2$ partial pressure. Specifically, while the CO partial pressure is about 10% in the heat treatment apparatuses according to the first and second embodiments, the CO partial pressure is about 20% in the heat treatment apparatus of this embodiment, which is generally twice as large as the CO partial pressure in the heat treatment apparatuses according to the first and second embodiments. Accordingly, in the heat treatment apparatus of this embodiment, the materials to be treated 519 can be heat-treated in the atmosphere having strong reducing property, so that decarbonization can be prevented and efficient bright treatment can be performed. In the present embodiment, steel materials which are decarbonized as raw materials can be recarburized. At the same time, in the heat treatment apparatus of this embodiment, there is a problem that the high CO partial pressure and the low $CO_2$ partial pressure cause a problem that soot generation (sooting) tends to occur. In this embodiment, the $CH_4$ sensor 520A that measures $CH_4$ partial pressure, which is a particularly important factor of occurrence of sooting, is used to measure $CH_4$ partial pressure of the converted gas supplied to the heat treatment furnace 51. At the same time, $CH_4$ partial pressure of the atmosphere gas taken in via the gas sampling device 512 is measured by a $CH_4$ sensor 520B. More specifically, in order to prevent occurrence of sooting due to the $CH_4$ partial pressure of the converted gas output from the gas converter 824 becoming higher than a specified value, the control unit 534 performs continuous monitoring of $CH_4$ partial pressure with the $CH_4$ sensor 520A, while controlling the flow control valve 521C to adjust the flow rate of hydrocarbon gas with reference to a computing signal resulting from computing a sensor signal from the $CH_4$ sensor 520A with the arithmetic processor 533. Moreover, the $CH_4$ partial pressure information measured by the $CH_4$ sensor 520B is sent to the control unit 534 or the arithmetic processor 533, and in a similar way as described in the foregoing, the control unit 534 controls the flow control valve 521C to adjust the flow rate of hydrocarbon gas. More specifically, in the heat treatment apparatus of this embodiment, $CH_4$ partial pressure is doubly measured and feedback control is performed based on the measured values to prevent occurrence of sooting. In other words, $CH_4$ partial pressure of the atmosphere gas supplied to the heat treatment furnace 51 and $CH_4$ partial pressure of the atmosphere gas in the heat treatment furnace 51 are simultaneously measured so as to perform control that prevents occurrence of sooting, so that the heat treatment furnace 51 may stably be operated. The configuration of the arithmetic processor 533 and the calculating method of $\Delta G^0$ in the present embodiment are basically similar to those in the first and second embodiments.

Figure 9:
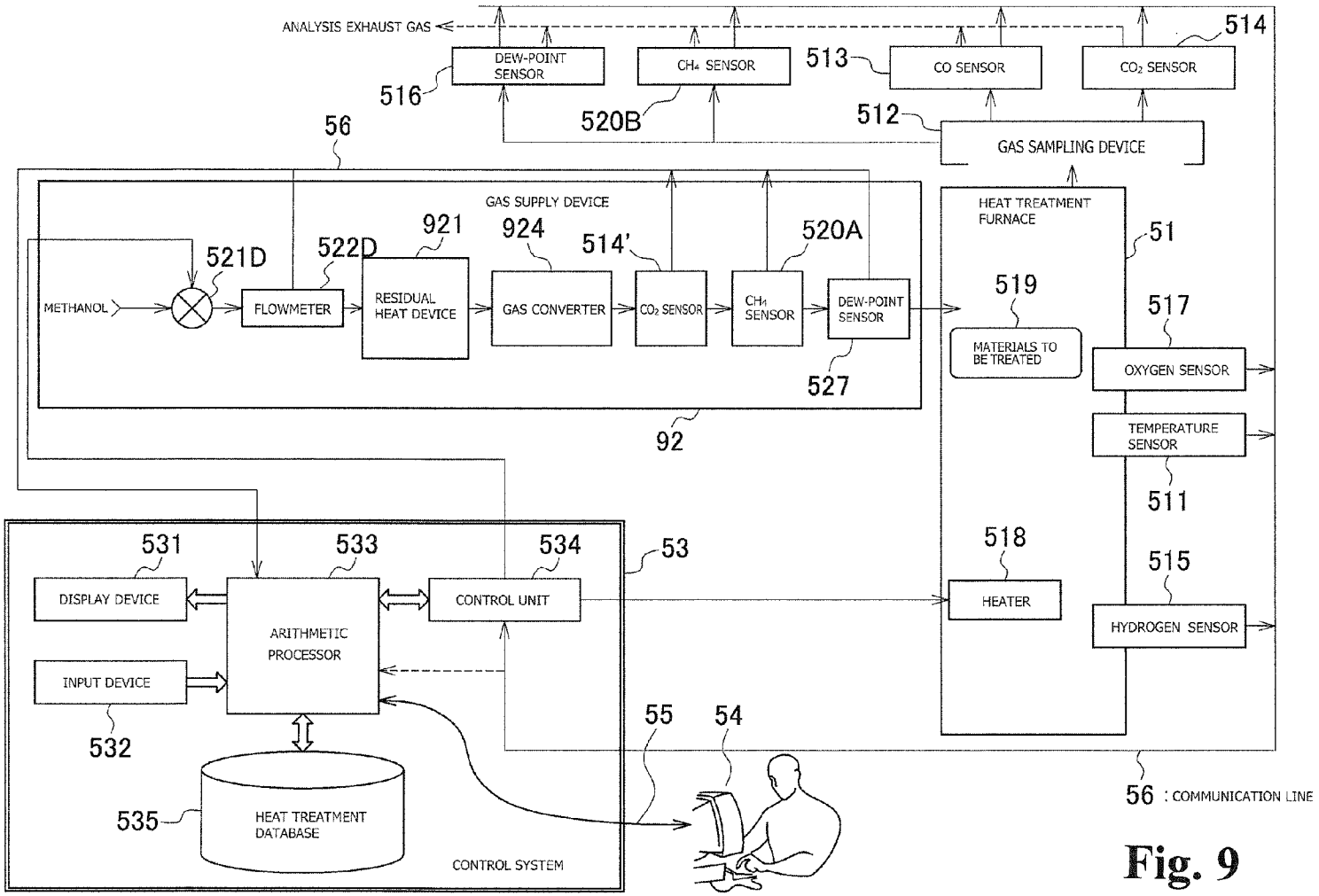
FIG. 9 is a block diagram illustrating the schematic configuration of a fourth embodiment of the heat treatment apparatus of the present invention.

A description is now given of a fourth embodiment of the heat treatment apparatus of the present invention with reference to FIG. 9.

A gas supply device 92 illustrated in FIG. 9 includes: a residual heat device 921 that preheats and gasifies alcohol such as methanol supplied as liquid via a flow control valve 521D and a flowmeter 522D; a gas converter 924 that pyrolyzes the gas from the residual heat device 921 according to a following formula (8); and a dew-point sensor 527 that measures a dew point of the converted gas from the gas converter 924 and supplies the gas to the heat treatment furnace 51 as atmosphere gas.

$$CH_3OH \rightarrow CO+2H_2 \quad (8)$$

In the heat treatment apparatus in the fourth embodiment, as in the heat treatment apparatus in the third embodiment, the heat treatment furnace 51 has atmosphere gas having a high CO partial pressure and a low $CO_2$ partial pressure. Accordingly, heat treatment is performed in the atmosphere having a strong carburization property, so that the high-carbon material to be treated 519 can be prevented from being decarbonized, and efficient bright treatment can be performed. Like the heat treatment apparatus in the third embodiment, the heat treatment apparatus of this embodiment has a problem that sooting tends to occur. Accordingly, as in the third embodiment, $CH_4$ sensors 520A and 520B and a $CO_2$ sensor 514' are provided, so that the flow rate of methanol is controlled with a flow control valve 521D.

In the present embodiment, steel materials which are decarbonized as raw materials can be recarburized. Although not illustrated, the atmosphere in the furnace may be diluted by using inert gas, such as nitrogen gas.

The configuration of the arithmetic processor 533 and the calculating method of $\Delta G^0$ in the present embodiment are basically similar to those in the first to third embodiments.

Figure 10:
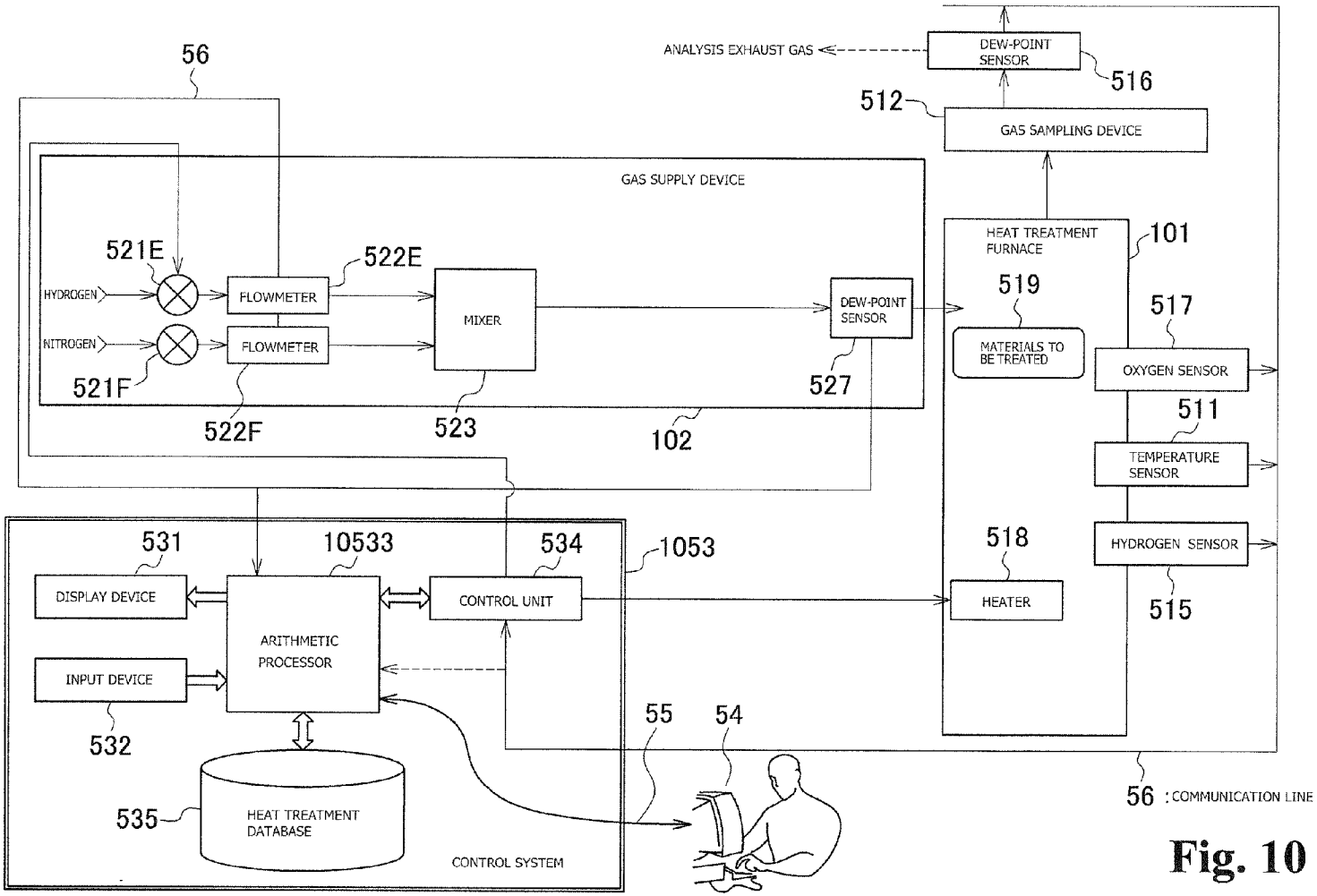
FIG. 10 is a block diagram illustrating the schematic configuration of a fifth embodiment of the heat treatment apparatus of the present invention.

A description is now given of a fifth embodiment of the heat treatment apparatus of the present invention with reference to FIG. 10.

A gas supply device 102 illustrated in FIG. 10 includes: a mixer 523 that mixes hydrocarbon gas supplied via a flow control valve 521E and a flowmeter 522E and nitrogen gas supplied via a flow control valve 521F and a flowmeter 522F; and a dew-point sensor 527 that measures a dew point of the gas from the mixer 523 and supplies the gas to a heat treatment furnace 101 as atmosphere gas. In the heat treatment apparatus according to the fifth embodiment, the hydrogen partial pressure in the heat treatment furnace 101 can easily be controlled with high precision by using only the flow control valve 521E. Since CO and $CO_2$ hardly exist in the heat treatment furnace 101, a chemical reaction between the surface of metal and atmosphere gas is simple, so that the control for implementing predetermined heat treatments, such as the bright treatment, can be simplified. Since CO partial pressure and $CO_2$ partial pressure are not detected in this embodiment, it is not necessary to provide the CO sensor and the $CO_2$ sensor.

While the configuration of an arithmetic processor 10533 and the calculating method of $\Delta G^0$ in this embodiment are basically similar to those in the first to fourth embodiments, the $CO/CO_2$ partial pressure ratio computation unit 62 illustrated in FIG. 6 is deleted. Therefore, $\Delta G^0$ is calculated by using the formula (1) or formulas (6) and (7) described before.

Figure 11:
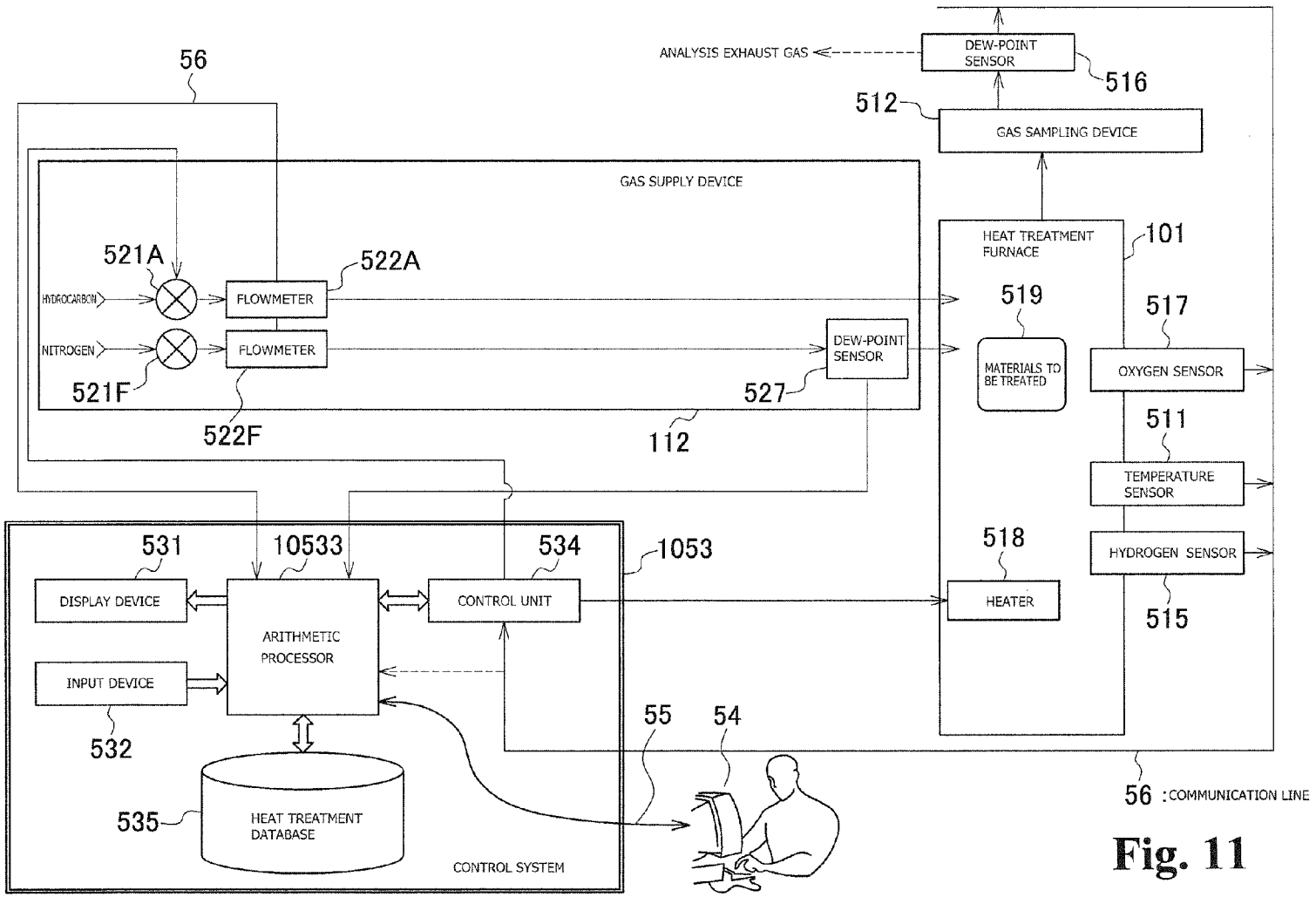
FIG. 11 is a block diagram illustrating the schematic configuration of a sixth embodiment of the heat treatment apparatus of the present invention.

A description is now given of a sixth embodiment of the heat treatment apparatus of the present invention with reference to FIG. 11.

The gas supply device 112 illustrated in FIG. 11 measures a dew point of nitrogen gas which is supplied via a flow control valve 521F and a flowmeter 522F, with a dew-point sensor 527 and supplies the gas to the heat treatment furnace 101 as carrier gas. Moreover, hydrocarbon gas is supplied, independently of carrier gas, to the heat treatment furnace 101 via the flow control valve 521A and the flowmeter 522A. In the heat treatment apparatus according to the sixth embodiment, hydrocarbon gas, such as propane and butane, reacts with oxidizing gas, such as oxygen and steam, in the heat treatment furnace 101 to produce a reducing atmosphere. Accordingly, the heat treatment such as the bright treatment may be performed on the materials to be treated 519 without causing decarbonization. In the heat treatment apparatus according to the sixth embodiment, hydrocarbon gas is directly supplied to the heat treatment furnace 101 without using a gas conversion furnace, and the atmosphere gas is generated by the heat treatment furnace 101 itself, so that the configuration of the heat treatment apparatus is very simple.

Although the dew-point sensor 527 detects a dew point of the nitrogen gas serving as carrier gas, it is hard to control the dew point of nitrogen gas itself in this embodiment. Accordingly, the arithmetic processor 10533 compares the information input from the dew-point sensor 527 with a set value stored in the heat treatment database 535 and controls to output an alarm when the dew point is larger than the set value. In this case, the dew-point sensor 527 may be replaced with an oxygen sensor or the like, so as to indirectly detect whether or not the dew point of carrier gas is normal.

The configuration of the arithmetic processor 10533 and the calculating method of $\Delta G^0$ in this embodiment are basically similar to those of the above-described fifth embodiment. In this embodiment, as in the fifth embodiment, CO partial pressure and $CO_2$ partial pressure are not detected, so that it is not necessary to provide the CO sensor and the $CO_2$ sensor.

In the above embodiments, the dew-point sensor 527 is provided on an output portion of the gas supply devices 52, 72, 82, 92, 102 and 112, and the dew point of the atmosphere gas supplied from these gas supply devices 52, 72, 82, 92, and 102 is controlled to be a set value or below. However, a CO sensor, a $CO_2$ sensor, a hydrogen sensor, and an oxygen sensor may be provided on the output portion of the gas supply devices 52, 72, 82, 92, 102 and 112, so that CO partial pressure, $CO_2$ partial pressure, $H_2$ partial pressure, $H_2O$ partial pressure, and $O_2$ partial pressure may be controlled to be equal to their respective set values.

Next, the heat treatment database 535 illustrated in FIG. 5 will be described in detail.

Figure 12:
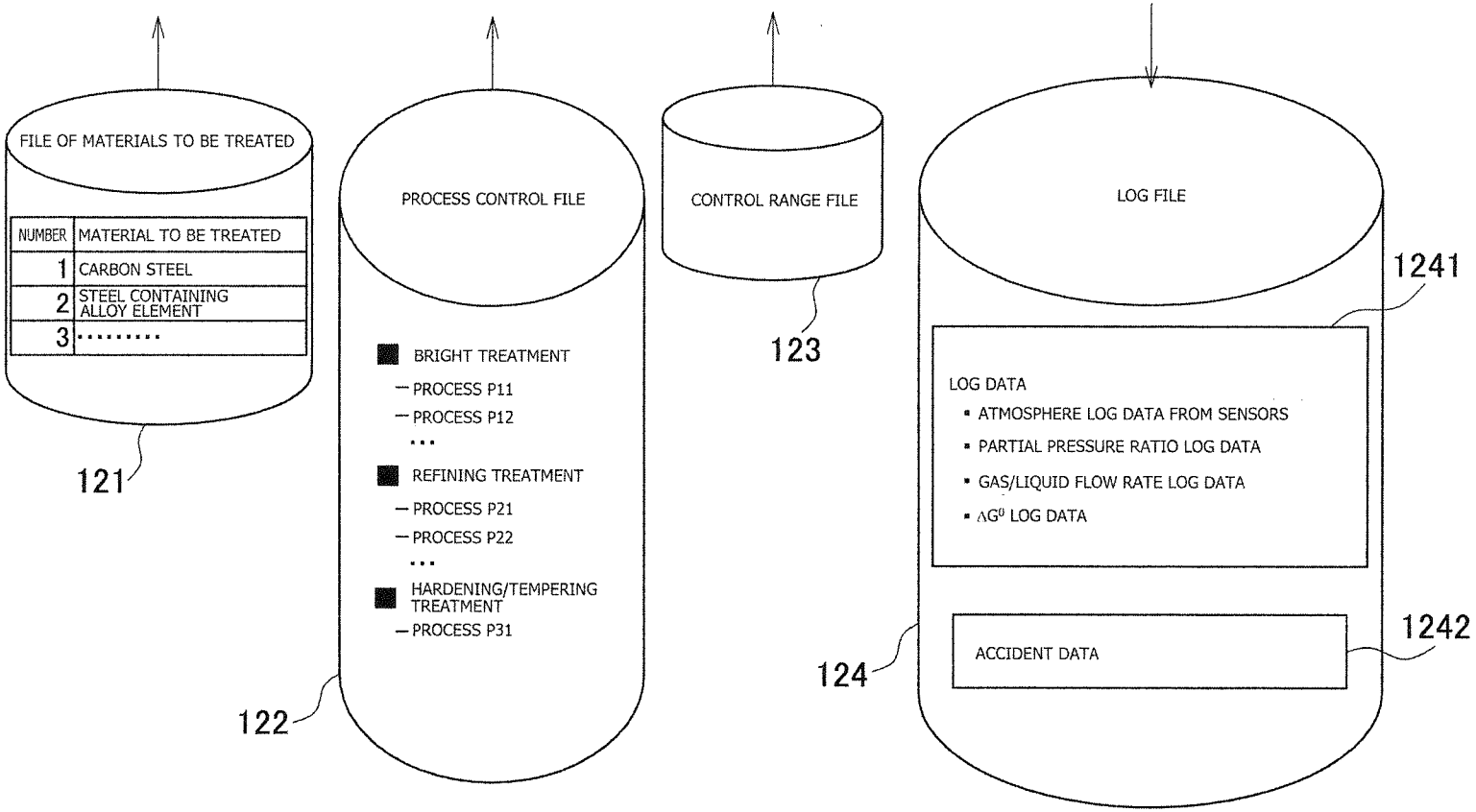
FIG. 12 is a block diagram illustrating a concrete configuration example of a heat treatment database illustrated in FIGS. 5 and 7 to 11.

The heat treatment database 535 includes, as illustrated in FIG. 12, a file of materials to be treated 121, a process control file 122, a control range file 123, and a log file 124. The file of materials to be treated 121 prestores the materials to be treated 519, which are subjected to heat treatment in the heat treatment furnaces 51 and 101, together with their numbers in a table format or as a library. As the materials to be treated, various materials, such as carbon steel and steel containing an alloy element, are registered.

The process control file 122 stores specific process names, such as bright treatment, refining treatment, and hardening/tempering treatment, and process conditions corresponding to the process names in a table format or as a library for each material to be treated 519. The process conditions include, as respective default values, temperature of the heat treatment furnaces 51 and 101, CO partial pressure, $CO_2$ partial pressure, $H_2$ partial pressure, $H_2O$ partial pressure, and $O_2$ partial pressure, a $CO/CO_2$ partial pressure ratio as a result of computation in the $CO/CO_2$ partial pressure ratio computation unit 62, an $H_2/H_2O$ partial pressure ratio as a result of computation in the $H_2/H_2O$ partial pressure ratio computation unit 63, $\Delta G^0$ (standard formation Gibbs energy) as a result of computation in the $\Delta G^0$ computation unit 64, gas flow rates, such as a hydrocarbon flow rate, an air flow rate, a hydrogen flow, and a nitrogen flow rate from the flowmeters 522A to 522F, and a liquid flow rate such as a methanol flow rate, conveyance rates of the materials to be treated 519, and time control and process sequences of these parameters.

Based on an instruction from the input device 532, the arithmetic processors 533 and 10533 read from the heat treatment database 535, a table or library specified from the file of materials to be treated 121 and the process control file 122 which are stored in the form of a table or a library, and displays the table or library on the display device 531. An operator confirms the displayed content, and if the displayed heat treatment conditions are acceptable, the operator starts the heat treatment under the conditions. Therefore, in the case of changing the heat treatment, the heat treatment can easily be changed based on the above-described procedures, so that the heat treatment such as the bright treatment, the refining treatment, and the hardening/tempering treatment can promptly and flexibly be implemented.

Figure 13:
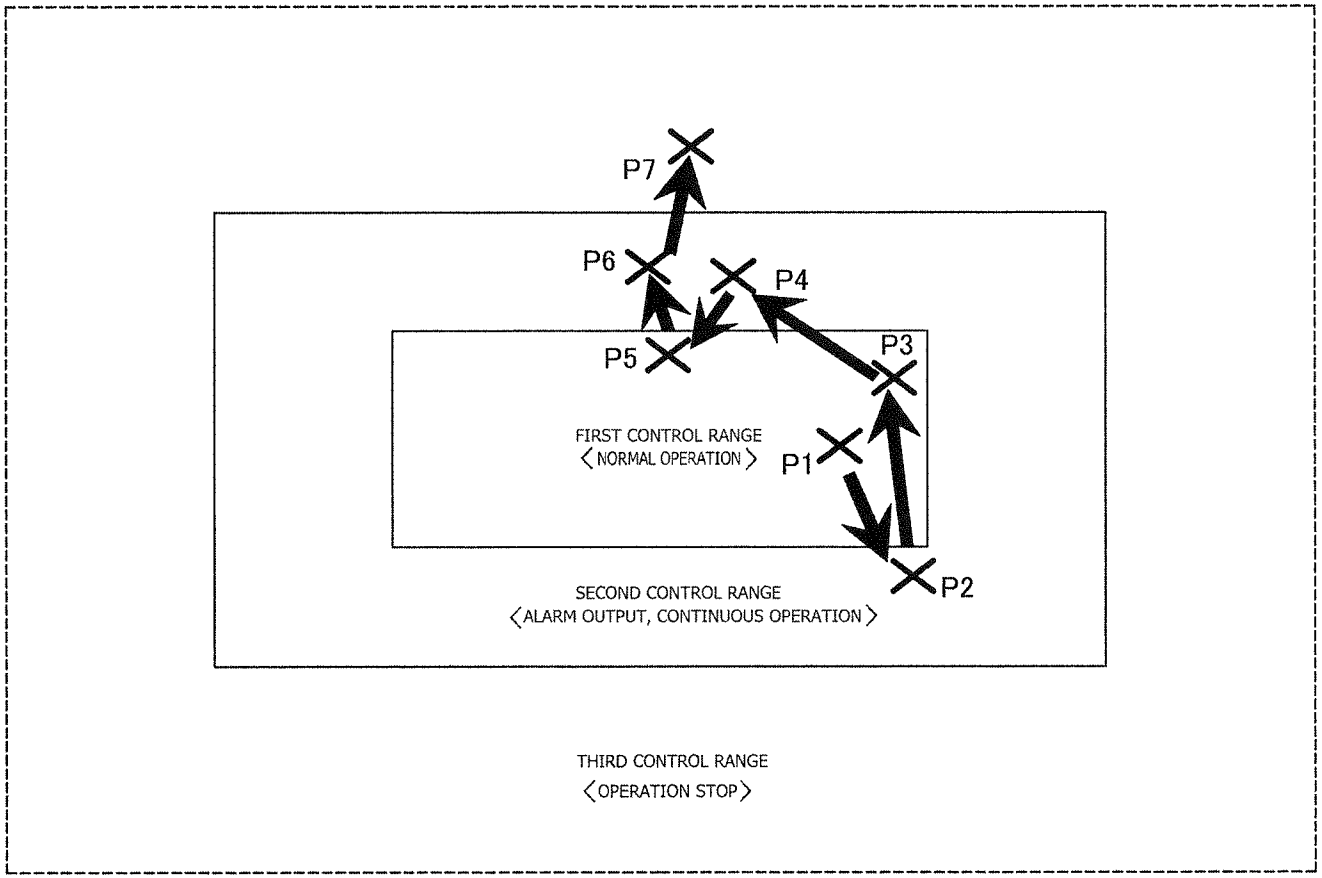
FIG. 13 is an explanatory view of a control range of the present invention.

As illustrated in FIG. 13, the control range file 123 is constituted of: a first control range indicative of a normal operation range; a second control range set outside the first control range, the second control range representing an operation range with caution required, though the second control range is out of the normal operation range; and a third control range set further outside the second control range, in which operation of the heat treatment furnaces 51 and 101 is stopped. In FIG. 13, temperature represents an abscissa while $\Delta G^0$ represents an ordinate of the control range. Although the shape of the control range is rectangular in FIG. 13, the shape is not necessarily limited thereto, and arbitrary shapes such as polygons and ellipses may also be used.

In FIG. 13, the second control range is provided adjacent to the outside of the first control range, and the third control range is provided adjacent to the outside of the second control range. However, they do not necessarily need to be provided adjacent to each other, and a buffer region may be provided between the respective control ranges.

The log file 124 has a log data file 1241 that stores parameters from respective sensors in real time, the parameters including temperature of the heat treatment furnaces 51 and 101, CO partial pressure, $CO_2$ partial pressure, $H_2$ partial pressure, $H_2O$ partial pressure, and $O_2$ partial pressure, a $CO/CO_2$ partial pressure ratio, an $H_2/H_2O$ partial pressure ratio, flow rates of gas or liquid that passes through the flowmeters 522A to 522F, conveyance rates of the materials to be treated 519, and $\Delta G^0$. The log file 124 also has an accident data file 1242 including the above log data file for the second control range and third control range illustrated in FIG. 13.

Now, the control unit 534 will be described with reference again to FIG. 6. The control unit 534 inputs temperature T input from the temperature sensor 511 via the sensor I/F 67, and reads a specified temperature T0 from the process information stored in the heat treatment database 535 specified through the input device 532 to control electric current passed to the heater 518 so that ΔT (=T−T0) is equal to 0, i.e., the temperature T is matched with the temperature T0.

By using $\Delta G^0$ from the $\Delta G^0$ (standard formation Gibbs energy) computation unit 64 and the information on the control range R1, the control unit 534 controls the flow control valves 521A, 521C, 521D, and 521E to control various gas flow rates and a flow rate of liquid such as methanol so that the status expressed by $\Delta G^0$ is aligned with the center of the control range. The control range R1 is in a region set below the approximate straight line L1, where the materials to be treated 519 are reduced. At the same time, the control range R1 is also set below the approximate straight line L2, so that carbon (C) is also in a reduction region. This prevents a problem of decarbonization due to oxidation of carbon present on the surface of the materials to be treated 519.

Figure 23:
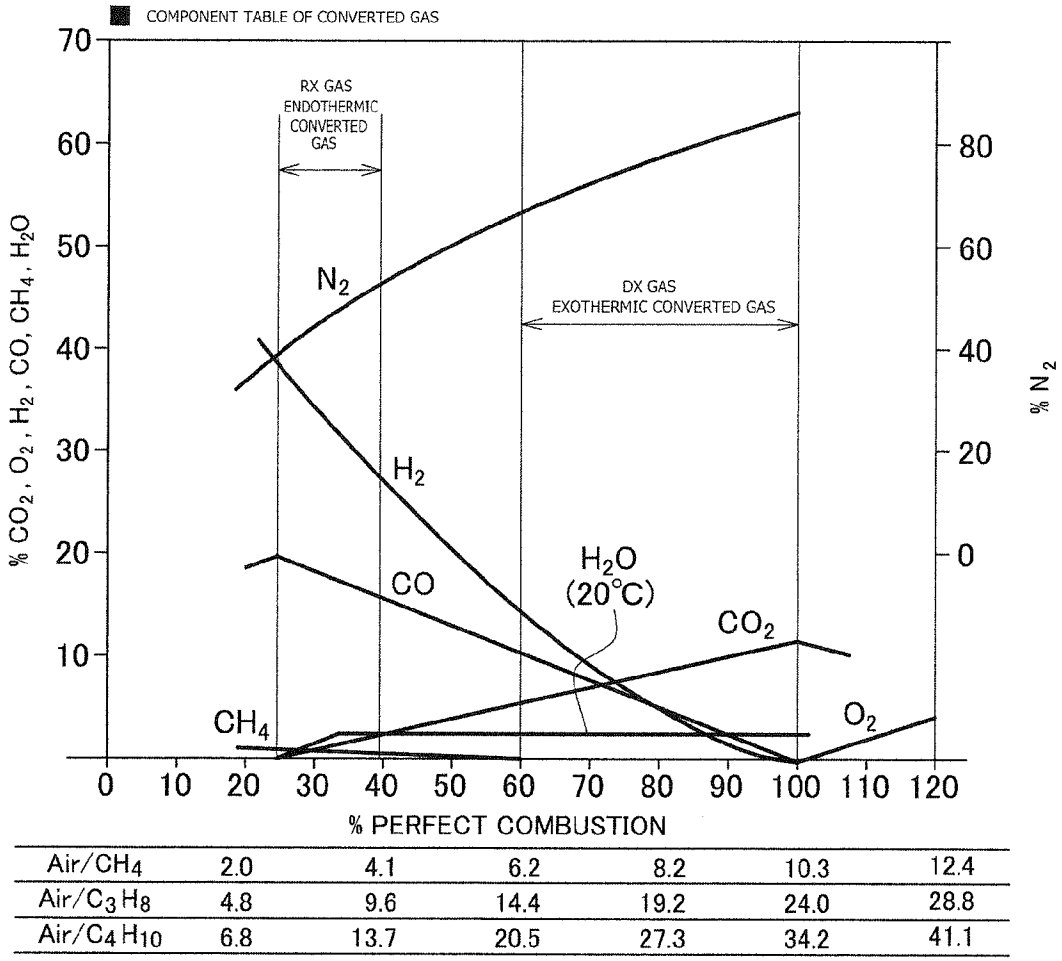
FIG. 23 illustrates an air-fuel ratio and a component ratio of converted gas emitted at the time of combusting hydrocarbon gas.

The atmosphere gas inside the heat treatment furnace 51 and 101 is more oxidizing as $\Delta G^0$ is higher in the Ellingham diagram, whereas the atmosphere gas is more reducing as $\Delta G^0$ is lower in the Ellingham diagram. If the flow control valve 521A illustrated in FIGS. 5, 7 and 11 and the flow control valve 521C illustrated in FIG. 8 are controlled to increase the flow rate of hydrocarbon gas, then carbon monoxide (CO) and hydrogen ($H_2$), which are reducing gas, increase as illustrated in FIG. 23, and the status P1 on the Ellingham diagram shifts downward. On the contrary, if the flow rate of hydrocarbon gas is decreased, carbon dioxide ($CO_2$), which is an oxidizing gas, increases while hydrogen gas ($H_2$) and carbon monoxide (CO), which are reducing gas, decrease so that the status P1 on the Ellingham diagram shifts upward. If the flow rate of hydrocarbon gas is excessively increased, the degree of incomplete combustion of hydrocarbon gas increases so that soot is generated, which results in a possibility that carburization may occur in the materials to be treated 519. For this reason, a lower limit is provided for the control range, and the flow rate of hydrocarbon gas is controlled so that the flow rate does not exceed a fixed value.

When the flow control valve 521D of FIG. 9 is adjusted to increase the methanol flow rate, the partial pressures of CO and $H_2$ reducing gases increases as shown in formula (8). As a consequence, the status shifts downward on the Ellingham diagram.

Further, when the flow control valve 521E of FIG. 10 is adjusted to increase the hydrogen flow rate, the same result as in the case of methanol is obtained since hydrogen is reducing gas.

When abnormalities occur in operation of the furnace, the control unit 534 stops operation of the heat treatment apparatus by such an action as stopping a conveyance mechanism that conveys the materials to be treated 519 to the heat treatment furnaces 51 and 101, based on the information from the status monitoring & abnormality processing unit 66.

When abnormalities occur, the control unit 534 outputs an abnormal signal to the display data generation unit 65. Upon reception of the signal, the display data generation unit 65 executes alarm processing such as blinking the status P1 displayed on the display device 531 or issuing an alarm sound.

Figure 14:
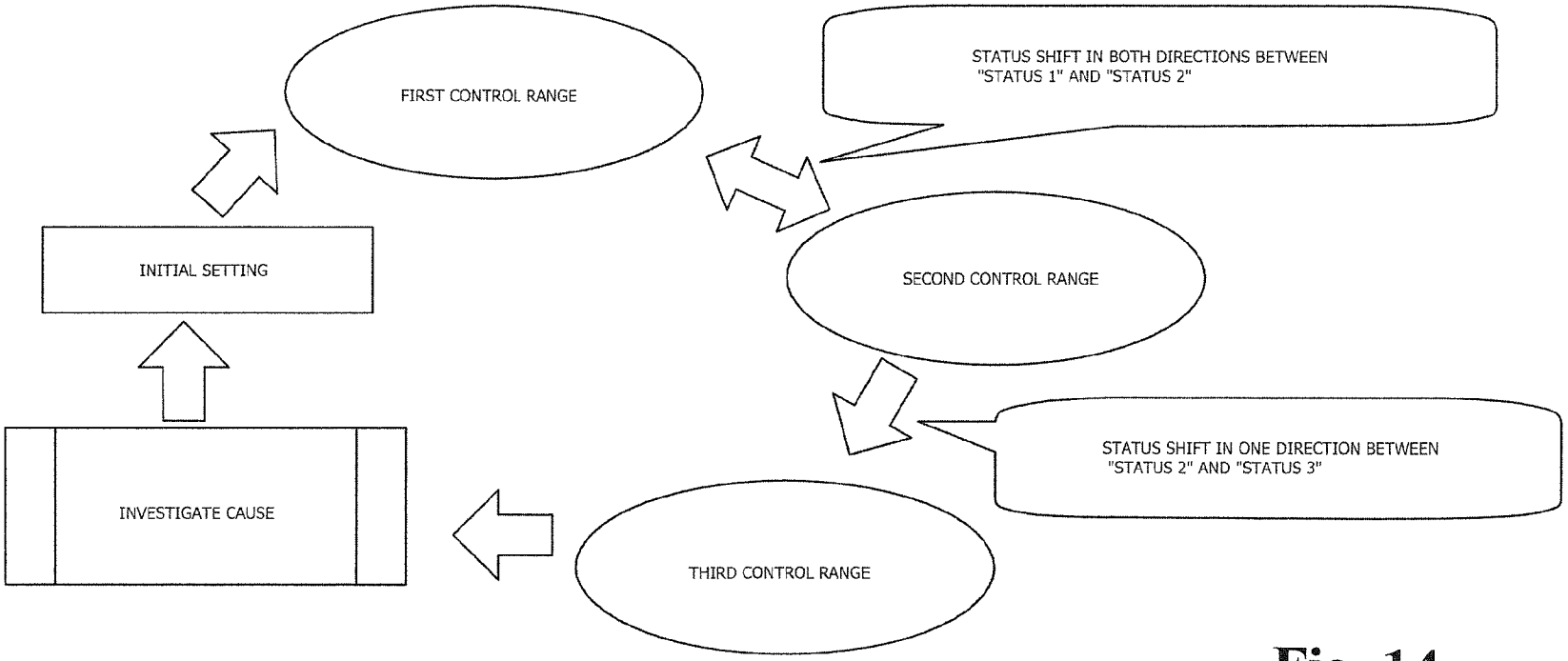
FIG. 14 is an explanatory view of the behavior of a status when the status shifts between the control ranges of the present invention.
Figure 15:
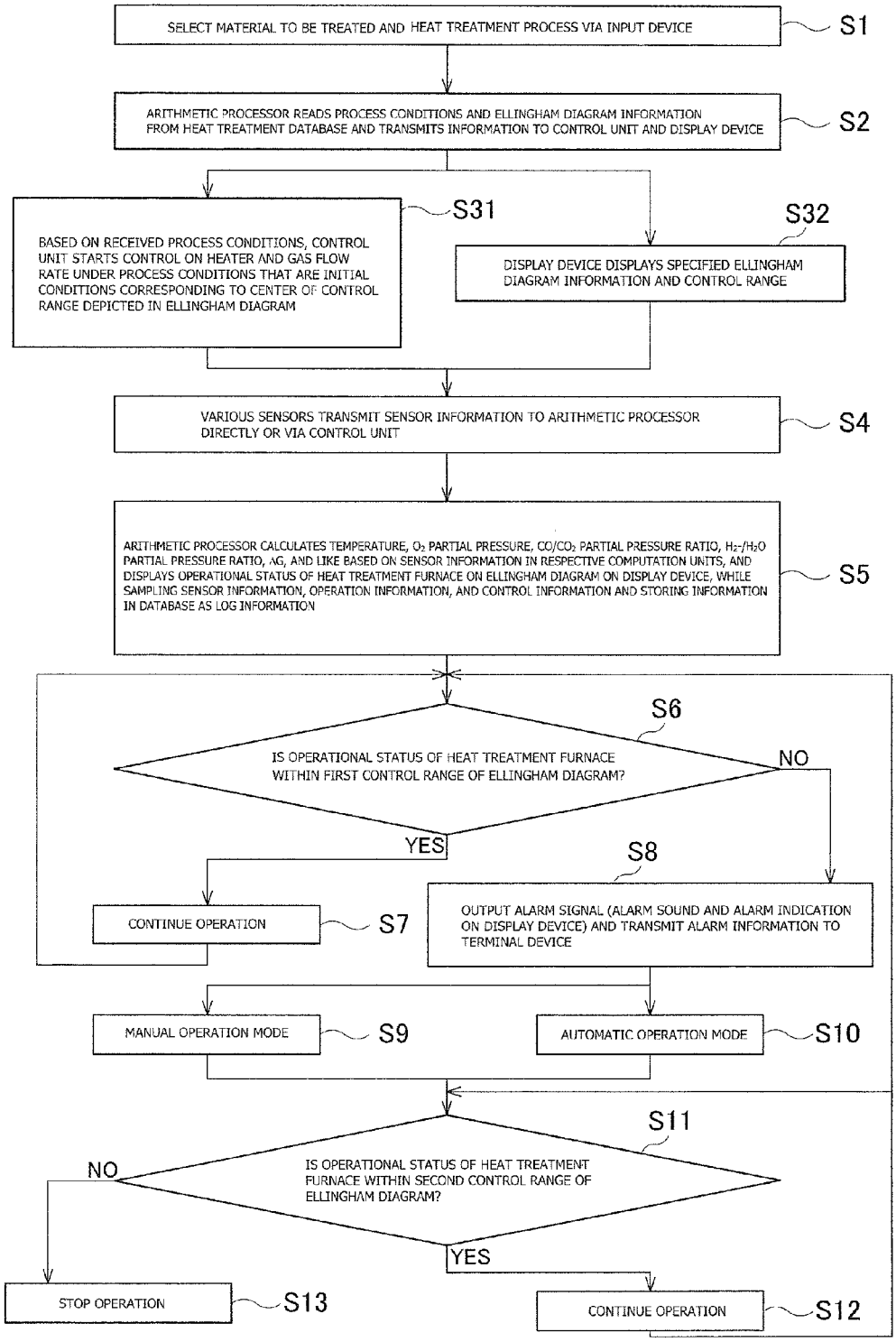
FIG. 15 is a flow chart illustrating a method for heat treatment of the present invention.

A description is now given of the method for heat treatment and the heat treatment apparatus of the present invention with reference to a flow chart illustrated in FIG. 15 and with reference to FIGS. 5 to 14 and 16.

In step S1, by using the input device 532, the materials to be treated 519 that are heat treatment target this time and a heat treatment process therefor are selected from a menu displayed on the display device 531. For example, carbon steel is selected as the materials to be treated 519, and P1 process is selected from the bright treatment as a heat treatment process.

Next, in step S2, the arithmetic processors 533 and 10533 read process conditions, Ellingham diagram information, and a control range from the heat treatment database 535, and output these pieces of information to the control unit 534 and the display device 531. In step S31, based on the received process conditions, the control unit 534 starts to control various gas flow rates and the flow rate of liquid such as methanol by controlling the heater 518, the flow control valves 521A, 521C, 521D, 521E, and the like so that temperature and $\Delta G^0$ are positioned at the center of the control range depicted in the Ellingham diagram. At the same time, the display device 531 displays the Ellingham diagram information and the control range in step S32.

Next, in step S4, various sensors output the detected sensor information to the arithmetic processors 533 and 10533 directly or via the control unit 534. The arithmetic processors 533 and 10533 generate $\Delta G^0$ calculated by the formulas (1), (4) and (7) with reference to the $O_2$ partial pressure, the $CO/CO_2$ partial pressure ratio, and the $H_2/H_2O$ partial pressure ratio calculated in the respective computation units 61 to 64, or $\Delta G^0$ calculated based on computation results of the plurality of formulas, as display data to be displayed on the Ellingham diagram of the display device 531, together with the control range and the approximate straight lines L1 and L2 illustrated in FIG. 6. At the same time, sensor information from the temperature sensor 511, the oxygen sensor 517, the flowmeters 522A to 522F and the like, computation information such as $O_2$ partial pressure as a result of computation in the oxygen partial pressure computation unit 61, a $CO/CO_2$ partial pressure ratio as a result of computation in the $CO/CO_2$ partial pressure ratio computation unit 62, an $H_2/H_2O$ partial pressure ratio as a result of computation in the $H_2/H_2O$ partial pressure ratio computation unit 63, and $\Delta G^0$ (standard formation Gibbs energy) as a result of computation in the $\Delta G^0$ computation unit 64, and control information such as drive current to the heater 518, and flow control information for the flow control valves 521A, 521C, 521D, and 521E are respectively stored in real time as the log data file 1241.

Next, in step S6, the status monitoring & abnormality processing unit 66 determines whether or not the operational status of the heat treatment furnace 51 and 101 is within the control range of the Ellingham diagram. When the operational status is within the control range of the Ellingham diagram, the status monitoring & abnormality processing unit 66 instructs the control unit 534 to continue operation. In step S7, the control unit 534 outputs control information for continuous operation to an unillustrated conveyance mechanism for the materials to be treated 519, the heater 518, and the flow control valves 521A, 521C, 521D, and 521E.

Contrary to this, when the operational status is out of the control range of the Ellingham diagram, the status monitoring & abnormality processing unit 66 instructs the display data generation unit 65 to execute alarm processing such as blinking the status P1 on the display device 531 or issuing an alarm sound. At the same time, as illustrated in FIGS. 5 and 7 to 11, alarm information is transmitted to the terminal device 54 which is distant from the heat treatment furnaces 51 and 101 via the communication line 55 in real time.

As a consequence, when the status P1 is out of the first control range, an urgent mail or the like is sent to the PC of a production management engineer and the like, so that the production management engineer can quickly access the accident data file 1242 in the heat treatment database 535. The production management engineer analyzes the data in the accident data file 1242 by using an accident analysis tool to find out the cause of the accident, and gives instructions to a production site to cope with the situation.

Next, the processing in the case where the operational status of the heat treatment furnaces 51 and 101 is out of the first control range of the Ellingham diagram in step S6 will be described in detail with reference to FIGS. 13 and 14.

When the status shifts from the first control range indicative of the normal operation to the second control range, the status monitoring & abnormality processing unit 66 instructs the display data generation unit 65 to execute alarm processing in step S8. At the same time, the status monitoring & abnormality processing unit 66 transmits alarm information to the terminal device 54 in real time via the communication line 55.

When the status shifts from the first control range to the second control range, the control unit 534 performs feedback control in real time so that the status returns to the first control range. As illustrated in FIG. 14, the status can shift in both directions between the first control range and the second control range. Operation modes in the second control range include: an automatic operation mode shown in step S10 in which the control unit 534 automatically performs all the control operations; and a manual operation mode shown in step S9 in which an operator or an engineer manually gives instructions to the control unit 534 to operate the heat treatment apparatus. Whether to select the automatic operation mode or the manual operation mode is instructed to the arithmetic processors 533 and 10533 through the input device 532, and mode change is performed accordingly.

When the status goes into the third control range (No in step S11), operation of the heat treatment furnaces 51 and 101 are stopped as illustrated in step S13 in both of the automatic operation mode and the manual operation mode so as to prevent production of defective articles. Specifically, a conveying operation of a conveyor or a roller that conveys the materials to be treated 519 is stopped to prevent new materials to be treated 519 from being input into the heat treatment furnaces 51 and 101. Once the status goes into the third control range as illustrated in FIG. 14, it is difficult for the status to return to the second control range, and therefore it is a general course of action to investigate the cause of the accident and to restart the heat treatment apparatus from initial setting.

When it is determined in step S11 that the operational status of the heat treatment furnaces 51 and 101 is within the second control range of the Ellingham diagram, operation is continued in step S12, and in step S6 or step S11, continuous monitoring of the operational status is performed to check which control range the status is positioned at.

In order to provide more detailed description with respect to the above-described operation, consider the case where the status P1 in the first control range shifts to a status P2 in the second control range in FIG. 13. The status P2 indicates that $\Delta G^0$ is lower than that in the status P1 in the Ellingham diagram, i.e., the status P2 has a higher reducing property. Accordingly, the control unit 534 controls to decrease the flow rate of reducing gas, such as hydrocarbon gas, in order to enhance oxidation nature of atmosphere gas. As a consequence, the status P2 goes into the first control range again and shifts to a status P3, but the status P3 soon goes into the second control range and shifts to a status P4. When such status shift is repeated and a status P6 in the second control range shifts to a status P7 in the third control range, it is generally difficult to shift from the status in the third control range to the status in the second control range. Accordingly, at the moment when the status shifts to the status P7, operation of the heat treatment furnace 61 is stopped.

As described in the foregoing, the control range is divided into the first control range to the third control range, and the control method is adjusted for each range, so that decrease in occurrence rate of defective lots and reduction in operation stop period are achieved. As a consequence, the heat treatment apparatus excellent in mass productivity can be provided.

Figure 16A:
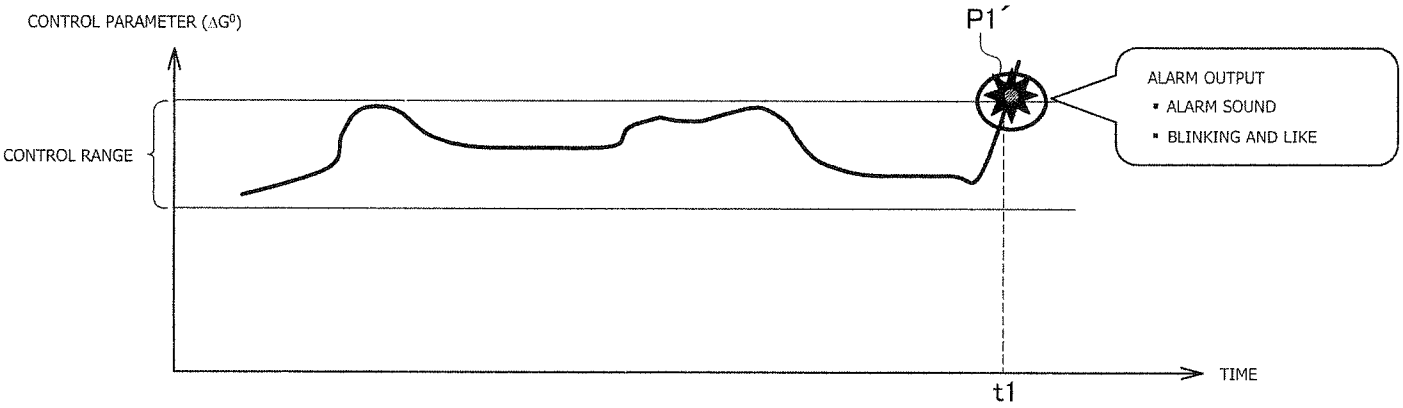
FIG. 16 illustrates a display example displaying a time change in control parameter on a display device of the present invention.
Figure 16B:
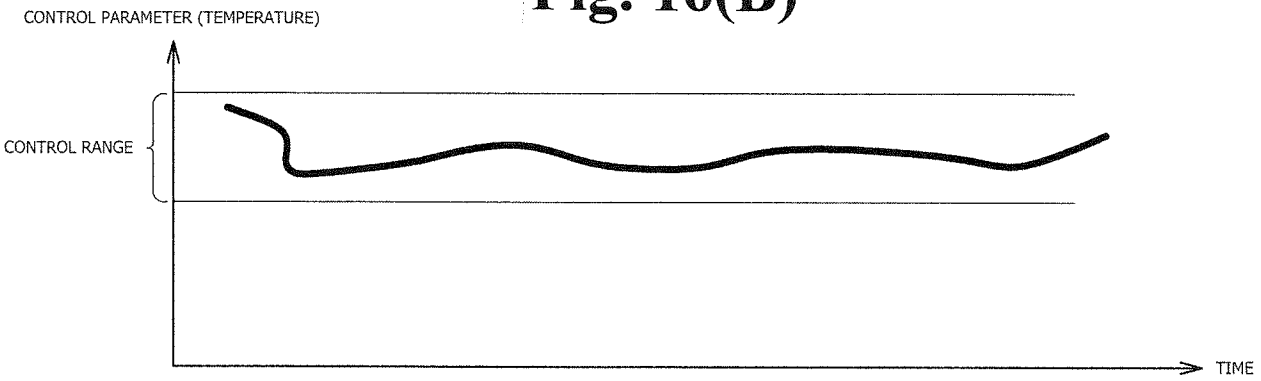

While FIG. 13 illustrates a two-dimensional control range with temperature as an abscissa and $\Delta G^0$ as an ordinate, FIGS. 16(A) and 16(B) illustrate these two parameters in the form of two different charts. FIG. 16(A) illustrates status change by using time as an abscissa and $\Delta G^0$ as an ordinate. Up to time t1, $\Delta G^0$ is within the control range, but at the time t1, $\Delta G^0$ exceeds an upper limit of the control range. In response to this event, the display data generation unit 65 executes alarm processing such as blinking a status P1' on the display device 531 or issuing an alarm sound. Although the case of using $\Delta G^0$ as a control parameter has been described in FIG. 16(A), residual oxygen partial pressure may be used as a control parameter and alarm processing may be executed when the residual oxygen partial pressure exceeds an upper control limit value.

Figure 17A:
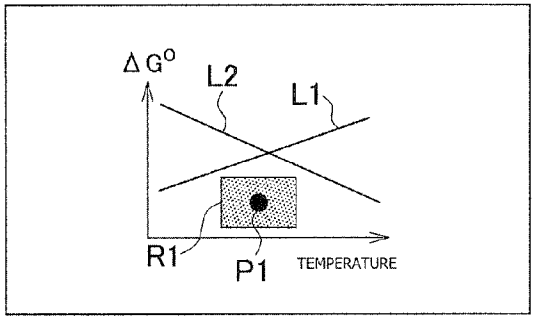
FIGS. 17(A), 17(B) and 17(C) illustrate display examples of the display device of the present invention.
Figure 17B:
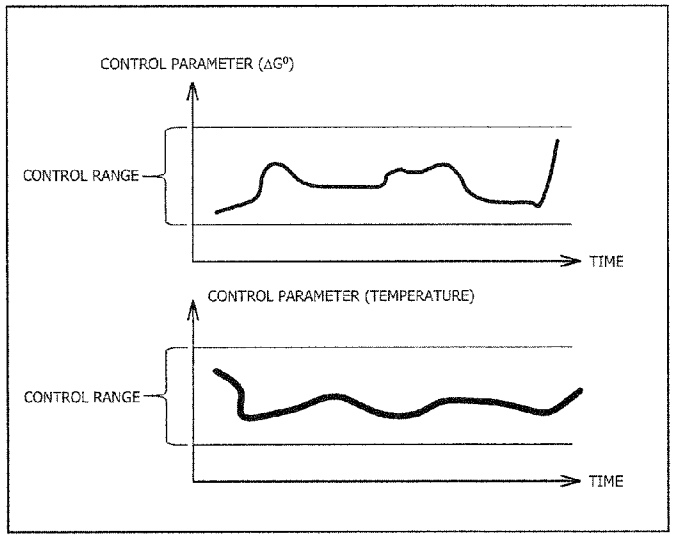
Figure 17C:
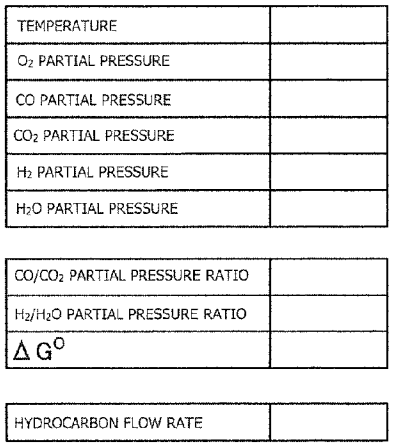

FIG. 17 illustrates information (A) to (C) displayed on an identical screen or a plurality of screens of the display device 531, the information (A) indicating the status in the Ellingham diagram, the information (B) indicating time transition in control parameter, and the information (C) indicating sensor information from the sensors, computation values, gas control information, and the like. The information (A) is effective for two-dimensional understanding of a current status from a perspective of the Ellingham diagram, while the information (B) is effective for understanding how the control parameters change with time. For example, the dew point from the dew-point sensor 527 is time-serially displayed, and when the dew point is out of the control range, it is determined that an abnormality occurs in the gas supply devices 52, 72, 82, 92, 102, and 112, and an alarm is output Meanwhile, the information (C) displays detailed control parameters in the status indicated in the information (A) or (B).

The method for heat treatment and the heat treatment apparatus according to the present invention are controlled by using the control range in the control range file 123 illustrated in FIG. 12. Accordingly, a method of determining the control range will be described with reference to FIG. 18.

In step S21, materials to be treated which are subjected to evaluation for determination of the control range are selected from various materials to be treated, such as carbon steel and steel containing an alloy element. In step S22, a process suitable for the materials to be treated that are selected in step S22, e.g., a process P1 of the bright treatment or the like, is selected. Next, in step S23, a plurality of process conditions for evaluation are prepared based on default process conditions of the selected process. Then, one process condition is selected from these process conditions for evaluation, and in step S24, the materials to be treated are heat-treated by using the heat treatment apparatuses illustrated in FIGS. 5 to 11 and the method for heat treatment illustrated in FIG. 15.

Next, in step S25, parameters including temperature of the heat treatment furnace 61, $O_2$ partial pressure, CO partial pressure, $CO_2$ partial pressure, $H_2$ partial pressure, $H_2O$ partial pressure, a $CO/CO_2$ partial pressure ratio, an $H_2/H_2O$ partial pressure ratio, gas flow rates such as a hydrocarbon flow rate, an air flow rate, a hydrogen flow and a nitrogen flow rate from the flowmeters 522A to 522F, and a flow rate of liquid such as a methanol flow rate, and $\Delta G^0$ are each stored as evaluation log data in the log data file 1241.

In step S26, it is determined whether or not all the process conditions for evaluation are tried. If all the process conditions for evaluation are not tried, a process condition for evaluation which is not yet tried is selected in S23, and processing in steps S24 and S25 is repeated so as to repeat the heat treatment in all the process conditions for evaluation.

In step S27, each material to be treated which is heat-treated in each process for evaluation is estimated. More specifically, color, surface hardness, present/absence and degree of decarbonization and carburization, and the like are estimated for each material to be treated. Based on the evaluation result, a control range which satisfies target specifications is determined in step S28.

Figure 19:
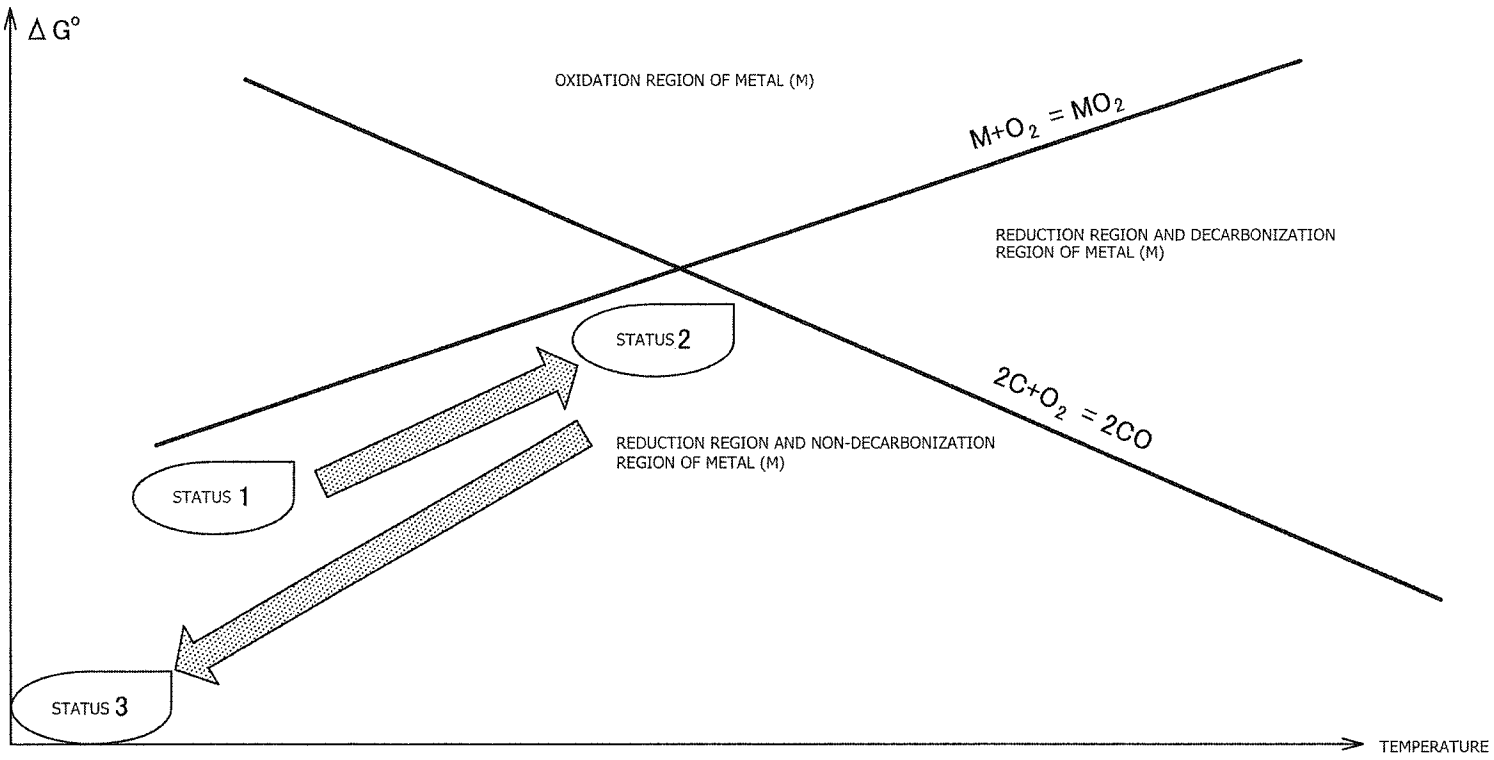
FIG. 19 is an explanatory view of a relationship between different heat treatments and statuses corresponding to these heat treatments on the Ellingham diagram in the method for heat treatment of the present invention.

A description is now given of other embodiments of the heat treatment apparatus of the present invention with reference to FIG. 19.

FIG. 19 illustrates status shift in order of status 1->status 2->status 3 as the materials to be treated 519 receive different heat treatments. For example, it is respectively indicated that the heat treatment in the status 1 is a heat treatment in a residual heat zone, the heat treatment in the status 2 is a heat treatment performed in a heating zone, and the heat treatment in the status 3 is a heat treatment in a cooling zone. The materials to be treated 519 move inside a continuous furnace by the conveyance mechanism such as a conveyor belt or a roller, so that the materials are heat-treated at temperatures and in atmosphere gases different by zone.

When a lot number of the materials to be treated 519 is specified through the input device 532, it is possible to instantly display on the display device 531 which zone and which status on the Ellingham diagram the materials to be treated 519 of that lot number are present, together with the position of the zone and the process conditions. As for the lot in the cooling zone, an Ellingham diagram in the heating zone where the lot was previously heat-treated can be traced back and displayed.

EXPERIMENTAL EXAMPLE

Figure 20:
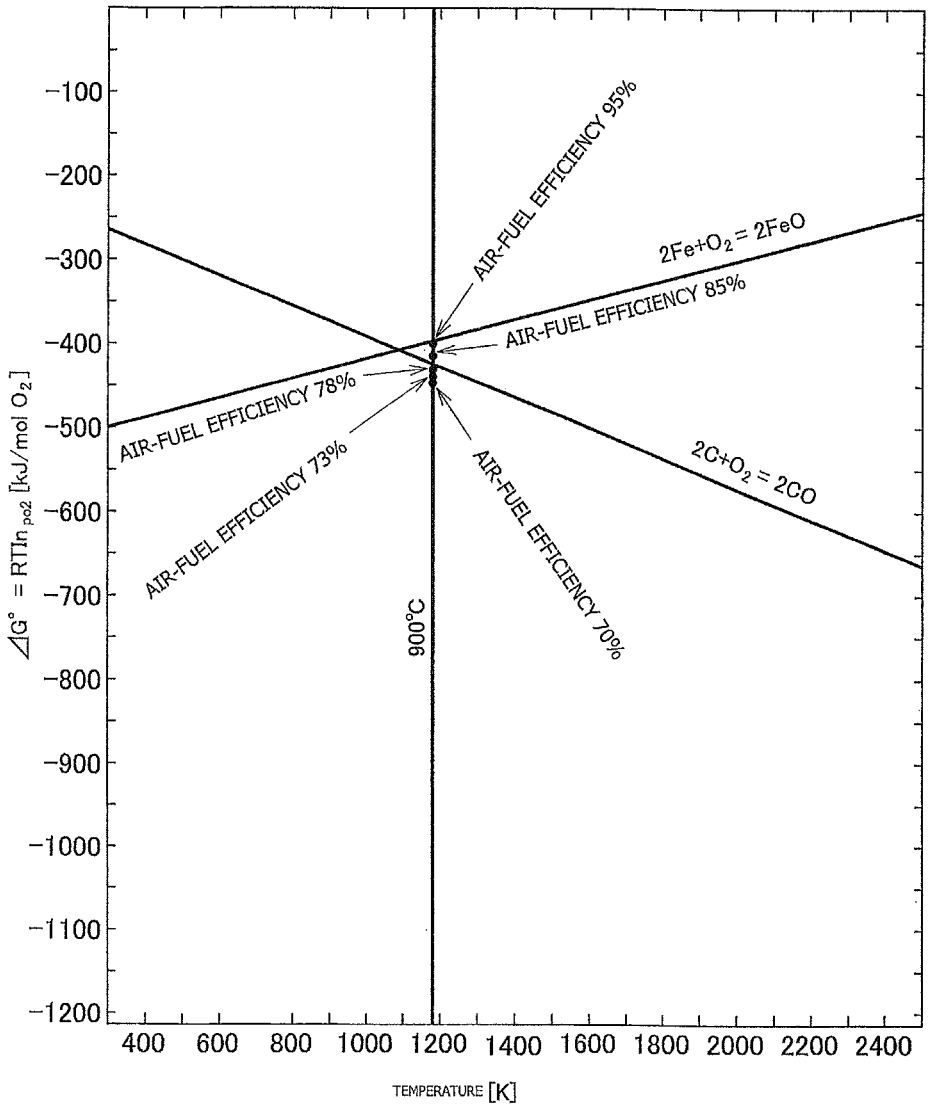
FIG. 20 is an explanatory view illustrating experimental data of the present invention in an Ellingham diagram.

FIG. 20 illustrates an Ellingham diagram as a result of an experiment in which carbon steel S45C was used as the materials to be treated 519, heat treatment temperature was 900° C. (1173K), and an air ratio between air and fuel was varied. A left-side ordinate expresses an axis of $\Delta G^0$ at 0° C., while an abscissa expresses absolute temperature (K).

An area above a straight line expressed by $2Fe+O_2=2FeO$ represents an iron oxidation region, while an area below the straight line represents iron reduction region. An area above a straight line expressed by $2C+O_2=2CO$ represents a carbon oxidation region, while an area below the straight line represents a carbon reduction region, i.e., a region free from decarbonization.

Figure 21:
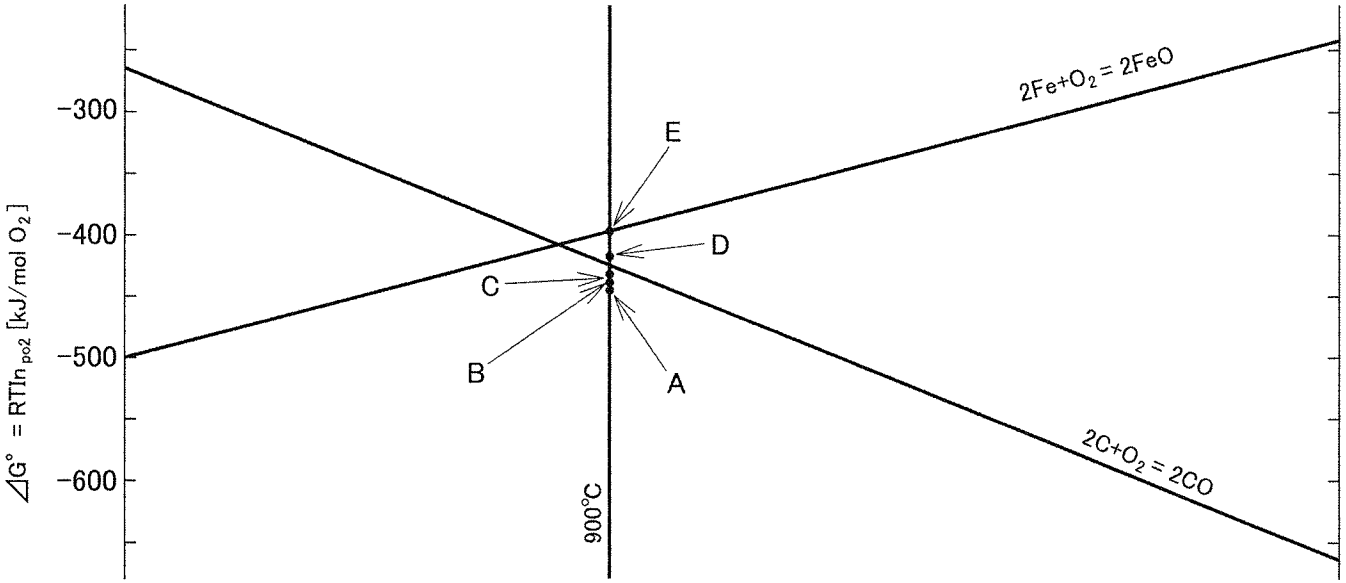
FIG. 21 is an enlarged view of FIG. 20 with a table illustrating heat treatment conditions.

FIG. 21 is an enlarged view of FIG. 20, which also illustrates statuses A to E on the Ellingham diagram, and air ratios and $CO/CO_2$ partial pressures corresponding to these statuses. FIG. 21 indicates that the regions where the materials to be treated are reduced (not oxidized) but not decarbonized are in the statuses A, B, and C. FIG. 22 illustrates evaluation results of the materials to be treated which were heat-treated with varied air ratios. The table indicates that the conditions of a surface hardness and a surface color are the best when the air ratio is 70%, i.e., at the time of $CO/CO_2=8.3/0.105=79$. It is also indicated that the upper limit of the control range may be set between the status A and the status B.

Figure 18:
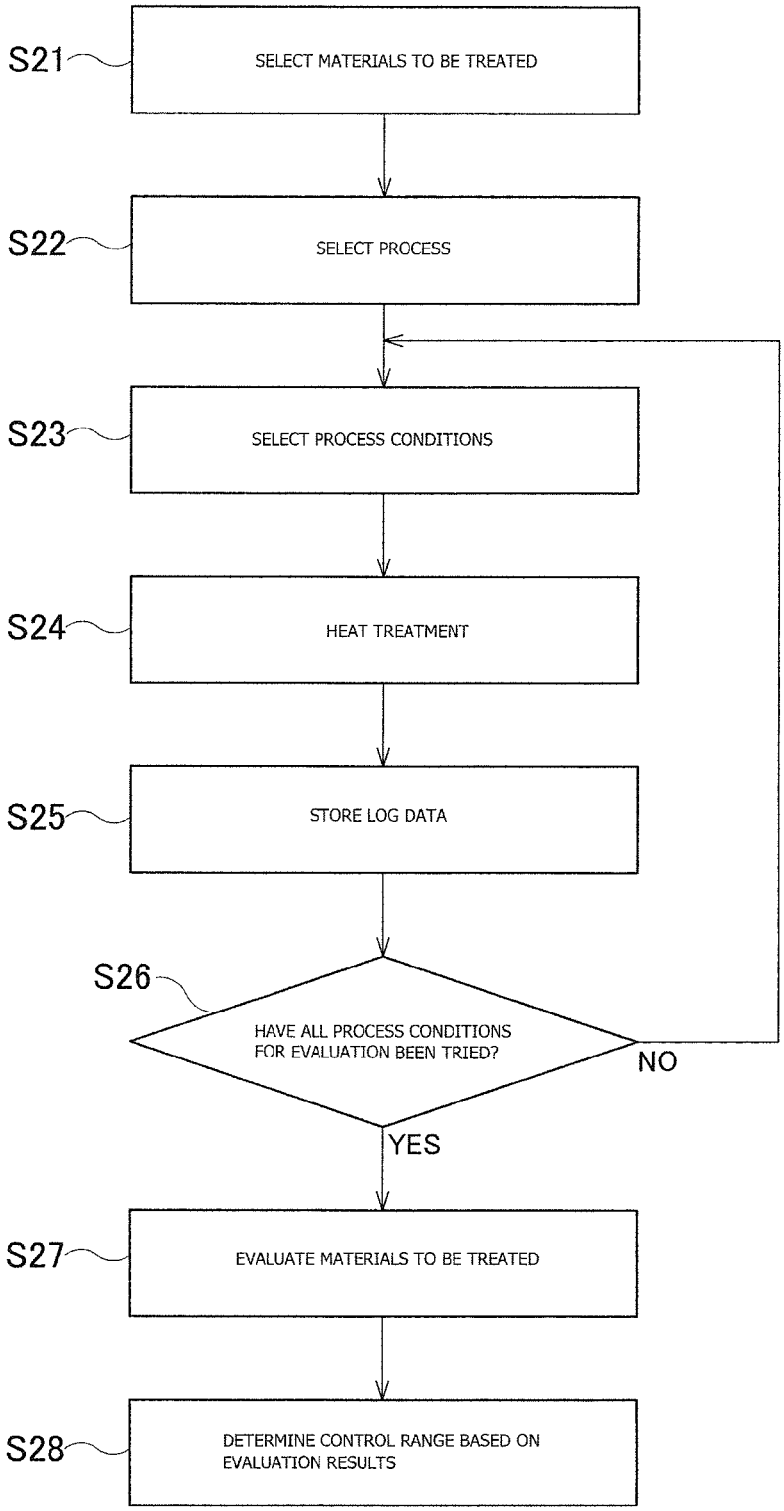
FIGS. 18 is a flow chart illustrating a method of determining the control range of the present invention.

As specifically described in the foregoing, preferred control ranges are determined for various materials to be treated and their processes based on the flow of FIG. 18, and are stored in the control range file 123 as a library. Since the heat treatment apparatus of the present invention uses this library, the heat treatment apparatus capable of performing flexible heat treatment can be provided.

In the above description, various gases, such as hydrocarbon gas, hydrogen gas, and nitrogen gas, are supplied to the gas supply device from gas supply sources, such as unillustrated tanks provided outside the gas supply device.

REFERENCE SIGNS LIST

11 Exothermic converted gas generator
12 Dehumidifier
13 Gas mixer
14 Hydrocarbon gas feeder
15 Gas converter with heating function
16 Gas quenching/dehumidifier system
17 Bright annealing furnace
18 Oxygen potentiometer
19 Carbon potential computation controller
21 Heat chamber
22 Oxygen analyzer
23 Carbon monoxide analyzer
24 Oxygen partial pressure setting unit
25 Carbon monoxide partial pressure setting unit
31 Heat treatment furnace
32, 33, 34 Oxygen sensor
35 Carburization chamber
36 Diffusion chamber
37 Soaking chamber
38 Regulator
39 Sequencer
41 Stainless steel
42 Bright annealing furnace
43 Reducing gas supply device
44 Refining device
45 Color difference meter
46 Control device
51, 101 Heat treatment furnace
52, 72, 82, 92, 102, 112 Gas supply device
53, 1053 Control system
54 Terminal device
55 Communication line
511 Temperature sensor
512 Gas sampling device
513 CO sensor
514 $CO_2$ sensor
515 Hydrogen sensor
516, 527 Dew-point sensor
517 Oxygen sensor
518 Heater
519 Material to be treated
521A to 521F Flow control valve
522A to 522F Flowmeter
523 Mixer
524, 824, 924 Gas converter
525 Water cooler
526 Dehumidifier
528 $CO_2$ absorber

531 Display device
532 Input device
533, 10533 Arithmetic processor
534 Control unit
535 Heat Treatment Database
61 Oxygen partial pressure computation unit
62 $CO/CO_2$ partial pressure ratio computation unit
63 $H_2/H_2O$ partial pressure ratio computation unit
64 $\Delta G^0$ (standard formation Gibbs energy) computation unit
65 Display data generation unit
66 Status monitoring & abnormality processing unit
67 Sensor I/F
921 Residual heat device
121 File of materials to be treated
122 Process control file
123 Control range file
124 Log File
1241 Log Data File
1242 Accident Data File

The invention claimed is:

1. A heat treatment apparatus for a heat treatment of steel materials, which is at least one of a bright heat treatment, a thermal refining treatment, and a hardening/tempering treatment, comprising:

a heat treatment furnace that heat-treats materials to be treated;

a gas supply device that supplies atmosphere gas to the heat treatment furnace;

a control system that controls the gas supply device by referring to sensor information from a temperature sensor and a $CO_2$ sensor, wherein the sensors detect an atmosphere status during heat treatment; and a terminal device that displays a display data via a communication line and transmits control information for controlling the control system;

wherein the control system comprises:

a standard formation Gibbs energy computation unit configured to calculate standard formation Gibbs energy($\Delta G^0$) of the atmosphere gas in the heat treatment furnace by referring to the sensor information; and a display data generation unit configured to use an Ellingham diagram corresponding to the material in the heat treatment furnace and the calculated standard formation Gibbs energy to generate the display data to be displayed on a display device, the display data generation unit generating the display data such that a status of the calculated standard formation Gibbs energy is displayed, together with a control range, on the Ellingham diagram on a display screen of the display device and is updated in real time on the display screen; and a control unit configured to control the gas supply device such that the calculated standard formation Gibbs energy enters the control range set on the Ellingham diagram, wherein the control range is in a region set below an approximate straight line as which standard formation Gibbs energy of the materials to be treated at respective temperatures is displayed, and is in a region set below the approximate straight line as which standard formation Gibbs energy in the reaction of $2C+O_2=2CO$ is displayed, wherein the control range includes:

a first control range indicative of a normal operation range of the heat treatment furnace;

a second control range outside the first control range; and a third control range outside the second control range, wherein the control system further comprises a status monitoring & abnormality processing unit configured to monitor the status of the calculated standard formation Gibbs energy on the Ellingham diagram, wherein the status monitoring & abnormality processing unit is configured to output an alarm when the status deviates from the first control range, and to output control information so as to stop the operation of the heat treatment apparatus when the status shifts to the third control range; and wherein the gas supply device configured to supply an exothermically converted gas (DX gas), includes:

a first flow control valve for supplying hydrocarbon gas, whose flow rate is controlled by the control system, to the heat treatment furnace;

a second flow control valve for supplying air to the heat treatment furnace;

a mixer that mixes hydrocarbon gas and air whose flow rates are controlled by the control system;

a gas converter that combusts the mixed gas from the mixer with a burner; and a water cooler for water-cooling and a dehumidifier for dehumidifying the gas from the gas converter so as to generate the DX gas.

2. The heat treatment apparatus according to claim 1, wherein the standard formation Gibbs energy computation unit performs computation by using any information or a plurality of information pieces out of oxygen partial pressure, carbon monoxide partial pressure and carbon dioxide partial pressure, and hydrogen partial pressure and dew point information to calculate the standard formation Gibbs energy.

3. The heat treatment apparatus according to claim 1, comprising a heat treatment database that stores at least one of process information on the materials to be treated, log information about operation of the heat treatment apparatus, and accident information.

4. The heat treatment apparatus according to claim 3, wherein the heat treatment database includes:

a file of materials to be treated that stores a list or a library of the materials to be treated including at least one of carbon steel and steel containing an alloy element; and a process control file that stores a list or a library of the heat treatment including at least one of a bright heat treatment, a thermal refining treatment, and a hardening/tempering treatment.

5. The heat treatment system according to claim 1, wherein when an abnormality occurs in the heat treatment apparatus, alarm information that reports the abnormality is displayed on the terminal device.

6. The heat treatment apparatus according to claim 1, comprising means for decreasing a concentration of carbon dioxide contained in the gas from the gas converter.

7. The heat treatment apparatus according to claim 1, wherein a transmission path for transmission from the sensor to the control system is formed from a dedicated sensor bus.

8. A heat treatment apparatus for a heat treatment of steel materials, which is at least one of a bright heat treatment, a thermal refining treatment, and a hardening/tempering treatment, comprising:

a heat treatment furnace that heat-treats materials to be treated;

a gas supply device that supplies atmosphere gas to the heat treatment furnace;

a control system that controls the gas supply device by referring to sensor information from a temperature sensor and a $CO_2$ sensor, wherein the sensors detect an atmosphere status during heat treatment; and a terminal device that displays a display data via a communication line and transmits control information for controlling the control system;

wherein the control system comprises:

a standard formation Gibbs energy computation unit configured to calculate standard formation Gibbs energy ($\Delta G^0$) of the atmosphere gas in the heat treatment furnace by referring to the sensor information; and a display data generation unit configured to use an Ellingham diagram corresponding to the material in the heat treatment furnace and the calculated standard formation Gibbs energy to generate the display data to be displayed on a display device, the display data generation unit generating the display data such that a status of the calculated standard formation Gibbs energy is displayed, together with a control range, on the Ellingham diagram on a display screen of the display device and is updated in real time on the display screen; and a control unit configured to control the gas supply device such that the calculated standard formation Gibbs energy enters the control range set on the Ellingham diagram, wherein the control range 2 is in a region set below an approximate straight line as which standard formation Gibbs energy of the materials to be treated at respective temperatures is displayed, and is in a region set below the approximate straight line as which standard formation Gibbs energy the reaction of $2C+O_2=2CO$ is displayed wherein the control range includes:

a first control range indicative of a normal operation range of the heat treatment furnace;

a second control range outside the first control range; and a third control range outside the second control range, wherein the control system further comprises a status monitoring & abnormality processing unit configured to monitor the status of the calculated standard formation Gibbs energy on the Ellingham diagram, wherein the status monitoring & abnormality processing unit is configured to output an alarm when the status deviates from the first control range, and to output control information so as to stop the operation of the heat treatment apparatus when the status shifts to the third control range; and wherein the gas supply device includes:

a first flow control valve for supplying hydrocarbon gas to the heat treatment furnace with a flow rate being controlled by the control system;

a second flow control valve for supplying air to the heat treatment furnace;

a mixer that mixes the hydrocarbon gas and air; and a gas converter, having a burner, that combusts the mixed gas from the mixer and supplies the mixed gas to the heat treatment furnace as an endothermically converted gas (RX gas).

9. A heat treatment apparatus for a heat treatment of steel materials, which is at least one of a bright heat treatment, a thermal refining treatment, and a hardening/tempering treatment, comprising:

a heat treatment furnace that heat-treats materials to be treated;

a gas supply device that supplies atmosphere gas to the heat treatment furnace;

a control system that controls the gas supply device by referring to sensor information from a temperature sensor and a $CO_2$ sensor, wherein the sensors detect an atmosphere status during heat treatment; and a terminal device that displays a display data via a communication line and transmits control information for controlling the control system wherein the control system comprises:

a standard formation Gibbs energy computation unit configured to calculate standard formation Gibbs energy ($\Delta G^0$) of the atmosphere gas in the heat treatment furnace by referring to the sensor information; and a display data generation unit configured to use an Ellingham diagram corresponding to the material in the heat treatment furnace and the calculated standard formation Gibbs energy to generate the display data to be displayed on a display device, the display data generation unit generating the display data such that a status of the calculated standard formation Gibbs energy is displayed, together with a control range, on the Ellingham diagram on a display screen of the display device and is updated in real time on the display screen; and a control unit configured to control the gas supply device such that the calculated standard formation Gibbs energy enters the control range set on the Ellingham diagram, wherein the control range is in a region set below an approximate straight line as which standard formation Gibbs energy of the materials to be treated at respective temperatures is displayed, and is in a region set below the approximate straight line as which standard formation Gibbs energy in the reaction of $2C+O_2=2CO$ is displayed, wherein the control range includes:

a first control range indicative of a normal operation range of the heat treatment furnace;

a second control range outside the first control range; and a third control range outside the second control range, wherein the control system further comprises a status monitoring & abnormality processing unit configured to monitor the status of the calculated standard formation Gibbs energy on the Ellingham diagram, wherein the status monitoring & abnormality processing unit is configured to output an alarm when the status deviates from the first control range, and to output control information so as to stop the operation of the heat treatment apparatus when the status shifts to the third control range; and wherein the gas supply device includes:

a flow control valve for supplying alcohol, whose flow rate is controlled by the control system;

a preheating device that evaporates the alcohol; and a gas converter, having a burner, that combusts the gas from the residual heat device to generate converted gas and supplies the converted gas to the heat treatment furnace.

* * * * *